US011707667B2

(12) United States Patent
Jiang et al.

(10) Patent No.: US 11,707,667 B2
(45) Date of Patent: Jul. 25, 2023

(54) POKER MACHINE AND CARD COLLATING DEVICE AND METHOD THEREOF

(71) Applicant: ZHEJIANG XUANHE ELECTROMECHANICAL TECHNOLOGY CO., LTD., Zhejiang (CN)

(72) Inventors: Zifa Jiang, Zhejiang (CN); Quxian Hu, Zhejiang (CN)

(73) Assignee: ZHEJIANG XUANHE ELECTROMECHANICAL TECHNOLOGY CO., LTD., Zhejiang (CN)

( * ) Notice: Subject to any disclaimer, the term of this patent is extended or adjusted under 35 U.S.C. 154(b) by 136 days.

(21) Appl. No.: 17/312,952

(22) PCT Filed: Dec. 12, 2019

(86) PCT No.: PCT/CN2019/124858
§ 371 (c)(1),
(2) Date: Jun. 11, 2021

(87) PCT Pub. No.: WO2020/119760
PCT Pub. Date: Jun. 18, 2020

(65) Prior Publication Data

US 2022/0072413 A1 Mar. 10, 2022

(30) Foreign Application Priority Data

Dec. 14, 2018 (CN) ..... 201811533375.9

(51) Int. Cl.
*A63F 1/14* (2006.01)
*A63F 1/12* (2006.01)
*A63F 1/00* (2006.01)

(52) U.S. Cl.
CPC ..... *A63F 1/14* (2013.01); *A63F 1/12* (2013.01); *A63F 2001/005* (2013.01)

(58) Field of Classification Search
CPC ..... A63F 1/14; A63F 1/12; A63F 2001/005; A63F 11/0002; G07F 11/52
See application file for complete search history.

(56) References Cited

U.S. PATENT DOCUMENTS 1,889,729 A * 11/1932 Hammond ..... A63F 1/14 271/42
3,666,270 A * 5/1972 Mazur ..... A63F 1/14 273/149 R (Continued)

FOREIGN PATENT DOCUMENTS

CN 201164714 12/2008
CN 102580307 7/2012

(Continued)

OTHER PUBLICATIONS

"International Search Report (Form PCT/ISA/210) of PCT/CN2019/124858," dated Mar. 13, 2020, with English translation thereof, pp. 1-5.

*Primary Examiner* — Michael D Dennis
(74) *Attorney, Agent, or Firm* — JCIPRNET

(57) ABSTRACT

Disclosed are a poker machine and a card collating device and method thereof. The card collating device includes a card collating base, a card collating channel outer side wall, and a center rotating disc The card collating base is directly or indirectly fixed on a base. The center rotating disc is arranged in the center of the card collating base. The center rotating disc is driven by a rotating disc electric motor to rotate. The card collating channel outer side wall is arranged outside the card collating base. An arc-shaped card collating channel for collating playing cards is formed between the center rotating disc and the card collating channel outer side (Continued)

wall. One end of the arc-shaped card collating channel is provided with a card discharging baffle. A card collating channel outlet is formed between the card discharging baffle and the bottom of the arc-shaped card collating channel.

9 Claims, 14 Drawing Sheets

(56) References Cited

U.S. PATENT DOCUMENTS

| | | | | | |
|---|---|---|---|---|---|
| 4,512,580 | A * | 4/1985 | Matviak | A63F 1/12 | 273/148 A |
| 4,667,959 | A * | 5/1987 | Pfeiffer | A63F 1/14 | 221/265 |
| 7,472,906 | B2 * | 1/2009 | Shai | A63F 1/12 | 273/149 R |
| 7,523,937 | B2 * | 4/2009 | Fleckenstein | A63F 1/12 | 273/149 P |
| 8,998,692 | B2 * | 4/2015 | Soltys | A63F 1/14 | 462/22 |
| 10,306,978 | B2 * | 6/2019 | Morag | A63F 1/14 | |
| 2010/0259002 | A1 * | 10/2010 | England | A63F 1/14 | 273/148 R |
| 2010/0320684 | A1 * | 12/2010 | Mali | A63F 1/14 | 273/149 R |
| 2011/0175285 | A1 * | 7/2011 | Tzeng | A63F 1/12 | 273/149 R |

FOREIGN PATENT DOCUMENTS

| | | |
|---|---|---|
| CN | 103055499 | 4/2013 |
| CN | 103157272 | 6/2013 |
| CN | 205235367 | 5/2016 |
| CN | 105854274 | 8/2016 |
| CN | 105854275 | 8/2016 |
| CN | 206881093 | 1/2018 |
| CN | 206881095 | 1/2018 |
| CN | 107803017 | 3/2018 |
| CN | 107875624 | 4/2018 |
| CN | 207627877 | 7/2018 |
| CN | 108452515 | 8/2018 |
| CN | 108452516 | 8/2018 |
| CN | 108525278 | 9/2018 |
| WO | 2018196759 | 11/2018 |

* cited by examiner

POKER MACHINE AND CARD COLLATING DEVICE AND METHOD THEREOF

CROSS-REFERENCE TO RELATED APPLICATION

This application is a 371 of international application of PCT application serial no. PCT/CN2019/124858, filed on Dec. 12, 2019, which claims the priority benefit of China application no. 201811533375.9, filed on Dec. 14, 2018. The entirety of each of the above mentioned patent applications is hereby incorporated by reference herein and made a part of this specification.

BACKGROUND

Field of the Disclosure

The disclosure relates to the field of poker machines, in particular to a poker machine, a card collating device and a card collating method thereof.

Description of Related Art

Playing poker cards is a popular entertainment. After playing a round, players need to collate, shuffle and deal cards by themselves. In order to save the time of dealing cards, automatic card dealers are invented to deal cards. For example, a patent document with publication number CN201164714Y discloses a playing card four-mouth distributor, which has a card-arranging cavity, and the center of the card-arranging cavity is provided with a card-arranging differential mechanism driven by a card-arranging electric motor. In the meantime, the circumference of the card-arranging differential mechanism is evenly distributed with four conveying belts which are connected to a card-dealing mechanism. The conveying belts are driven by a conveying electric motor, one side of each conveying belt is provided with a card-arranging wheel, and the other side is provided with a chock block matched with the card-arranging wheel which is provided with a spiral deflector rod. The output end of the card-dealing mechanism is provided with a counting optical eye. When the playing card machine is operated, the disordered cards are placed into the card-arranging cavity in the manner of facing down. The playing cards are discharged through the four mouths after passing through the card-arranging differential mechanism, the card-arranging wheel, and the card-dealing mechanism. Although the card dealer basically completes the shuffling and dealing actions, it still inevitable that the player(s) needs to collect, collate, and flip the playing cards that face different sides by themselves, resulting in high labor intensity and long waiting time in the game.

The patent document with the publication number CN102580307A discloses a full-automatic poker machine, which includes a mounting bottom plate and a plurality of support legs arranged at the bottom of the mounting bottom plate. A card inlet which is configured for feeding playing cards is disposed on the mounting bottom plate in the manner of being parallel with the desktop. A card cutting and primary card distributing equipment configured for primarily separating the disorder playing cards is disposed at one end of the card inlet. A card sorting and secondary card distributing equipment configured for arranging the playing cards to face the same direction and separating them into single pieces is arranged at the other end of the card cutting and primary card distributing equipment. A card flipping and dealing equipment configured for flipping single pieces of playing cards to face the same direction and deal the cards according to rules is disposed at the other end of the card sorting and secondary card distributing equipment. A card pushing equipment configured for pushing the dealt playing cards is arranged at the other end of the card flipping and dealing equipment. A card lifting equipment configured for ascending the playing cards to the desktop is disposed on one side of the card pushing equipment. Specifically, the card cutting and primary card distributing equipment realizes the initial card sorting (separating the playing cards into a number piles of cards) through the different rotation speeds of the card-feeding belt and the card-distributing belt. The card sorting and secondary card distributing equipment realizes collating cards (that is, to adjust the playing cards to face the same direction, i.e., to sort cards) by the means of secondary card distributing belt which conveys the playing cards as well as the card-collating belt and the auxiliary card-collating belt arranged at both sides. The card flipping equipment realizes flipping cards by the aids of the card-flipping plate and the three card-flipping belts designed with recess (to flip the playing cards to face the direction as required). The card dealing equipment realizes dealing cards randomly (that is, shuffling and dealing cards) by the aids of card dealing belt and the card dealing rod. The dealt cards directly fall on the card pushing panel and then pushed to the card ascending panel through the card pushing rod. Then the card ascending equipment lifts the playing cards to the desktop.

Although the playing cards machine basically realizes actions of collating cards, shuffling cards and dealing cards, such machine has the following defects due to its structural limitation:

1. Playing cards are likely to be jammed in the gap between the conveying belt and the peripheral wall, which often causes damage to the playing cards, and the playing cards are likely to be jammed or the equipment might function improperly.

2. The playing cards are placed in a flat manner on the conveying belt. Through the relative movement of the card collating belts arranged at both sides, the playing cards are moved to rotate within the horizontal plane and adjusted to face the same direction, so as to achieve the purpose of collating the cards. Such design causes the playing cards to float easily, get stuck between the card collating belts at both sides, or even damage the playing cards and cause the playing cards to be jammed in the gap between belts. Besides, such design has a higher requirement for the conveying speed and the length of the conveying belts, and the card collating efficiency is low accordingly.

3. The card flipping plate and three card flipping belts are adopted to flip the cards. Such design has the shortcomings of instability and low efficiency of the flipping cards, and the playing cards are also easily jammed in the gap between the belts.

4. The use of a card-dealing belt and a straight-line arrangement of multiple card-dealing ports has the disadvantages of unstable card-dealing action and low card-dealing efficiency, and the playing cards of multiple card positions are lifted in the same position, which makes it inconvenient for players to take cards, and cheating might take place as well.

The patent document with the publication number CN103055499A discloses a full-automatic poker machine, including: a card-feeding frame for placing playing cards, a card delivery mechanism for conveying playing cards is arranged at the bottom of the card-feeding frame; a card collating slot for placing the playing cards vertically is provided with at least two card collating components that can move relative to each other so that the playing cards can be moved out of the card collating slot in a manner that the lengthwise side is erected; a card erecting and transferring device for placing the cards sent out from the card-feeding frame vertically in the card collating slot; a card flipping device for flipping the cards is arranged at the outlet side of the card collating slot; a card dealing device for dealing the cards randomly to multiple card receiving boxes is disposed behind the card flipping device; multiple card lifting devices for lifting the playing cards in respective card receiving boxes to the desktop. The playing card machine adopts ordinary playing cards, and collate the cards in a vertical manner, which significantly increases the card collating accuracy and efficiency. However, such playing card machine is provided with a large number of components and the manufacturing cost is high.

The patent document with the publication number CN105854274A discloses a playing card machine and a card collating method thereof, which omits the card collating device and the card erecting and transferring device. By arranging a card discharging mechanism at the card discharging port of the current card feeding frame, the card discharging mechanism discharges a piece of playing card and flips the card after the card enters the card flipping device, then the card is dealt. Such machine can separate, flip, shuffle and deal a pile of cards that are organized into a pile. The machine has good card-shuffling efficiency, good reliability, and low manufacturing cost when being fabricated by machine. However, the card flipping device of such playing card machine can only send one mahjong to the card flipping box to be recognized, flipped and dealt. The card flipping efficiency is low, and the noise caused by flipping of cards is loud, the load for electric motor is high, the structure is complicated, and the stability is poor. Besides, the playing card machine has a loose arrangement in structure, a large size and low mounting efficiency.

SUMMARY OF THE DISCLOSURE

In order to solve the above problems, the purpose of the disclosure is to provide a poker machine and a card collating device and a card collating method thereof, which can automatically collate disordered playing cards in a coincident direction and deal out the playing cards, automatic and efficient card collating is realized, and various main device components are reasonable in arrangement, compact in structure and high in space utilization.

In order to achieve the above purpose, the present disclosure adopts the following technical solutions:

The card collating device of the poker machine includes a card collating base, a card collating channel outer side wall, and a center rotating disc, wherein the card collating base is directly or indirectly fixed on a base. The center rotating disc is arranged in the center of the card collating base, the center rotating disc is driven by a rotating disc electric motor to rotate. The card collating channel outer side wall is arranged outside the card collating base. An arc-shaped card collating channel for collating playing cards is formed between the center rotating disc and the card collating channel outer side wall. The bottom of the arc-shaped card collating channel is provided with a plurality of conveying rollers for conveying playing cards. One end of the arc-shaped card collating channel is provided with a card discharging baffle. A card collating channel outlet is formed between the card discharging baffle and the bottom of the arc-shaped card collating channel so as to allow the playing cards to be dealt out in a lengthwise direction of the playing cards. A storage box of a dealer is located below the card collating channel outlet for receiving the dealt playing cards. Specifically, the width of the arc-shaped card collating channel is smaller than the length of the playing card and greater than the width of the playing card, the distance between two adjacent conveying rollers is less than the length of the playing card, and the width of card collating channel outlet is similar to the width of the playing card.

Preferably, both ends of the arc-shaped card collating channel are provided with a card collating channel outlet, and the two card collating channel outlets are located above the opposite sides of the storage box.

Preferably, the top of the center rotating disc is a rotating disc upper tapered surface, and the lower edge of the rotating disc upper tapered surface is provided with several rotating disc card pushing slopes that are arranged along the circumference of the center rotating disc and protrude upward. The lower part of the center rotating disc is provided with a rotating disc side wall at a position close to the bottom of the card collating channel.

Preferably, the plurality of conveying rollers are distributed along the radial direction of the circular center rotating disc, and the conveying rollers adopt tapered rollers with a small inner radius and a large outer radius.

Preferably, the card collating channel outer side wall is mounted rotatably on the card collating base and is driven to rotate by an outer electric motor.

Preferably, the card collating channel outer side wall is formed integrally or fixed with an outer gear and a bottom gear. The outer electric motor fixed on the card collating base or the base is driven by the output gear and the outer gear that mesh with each other to drive the card collating channel outer side wall to rotate. The bottom gear meshes with the outer gear of the conveying rollers to drive the conveying rollers to rotate.

Preferably, a card discharging mechanism is arranged on the card discharging baffle of the card collating channel outlet, and the card discharging mechanism includes a card discharging active roller and a pressing roller thereof driven by the card discharging electric motor.

Preferably, an upper casing for covering the center rotating disc and the card collating channel is fixed above the card collating base.

Preferably, a control disk is arranged above the center rotating disc, and the control disk is driven up and down by the central lifting mechanism. When the control disk is raised, the card feeding port for placing playing cards is formed underneath the control disk, and the control disk is lowered to cover the card feeding port.

Preferably, the central lifting mechanism includes a lifting guide rod, a lifting base, a central lifting cam, and a central lifting electric motor. The control disk is fixed on the upper end of the lifting guide rod. A lifting base is sleeved on the outside of the lifting guide rod, and the lifting base is fixed on the card collating base. The lower part of the lifting base is sleeved with a central lifting cam, both sides of the lifting base are provided with grooves. The lower end of the lifting guide rod is fixed with a support rod, and both ends of the support rod extend out of the groove on the lifting base and can move up and down along the groove. The two protruding ends of the support rod abut against the cam curved surface on the central lifting cam. The central lifting cam is driven to rotate by the central lifting electric motor, thereby driving the support rod and its lifting guide rod to move up and down, and then drive the control disk on the top of the lifting guide rod to move up and down.

Preferably, the center rotating disc is sleeved outside the lifting base, and the upper end of the lifting base extends from the top of the center rotating disc. The two are connected by a bearing and can rotate relative to each other. The bottom of the center rotating disc is integrally formed or fixed with an inner gear ring. The inner gear ring is drivenly connected to the rotating disc electric motor mounted on the card collating base.

A poker machine includes the card collating device as described above.

A card collating method for poker machine includes the above-mentioned card collating device. When cards are collated, disordered playing cards are pushed to the arc-shaped card collating channel by the center rotating disc. The playing cards having the lengthwise direction that is substantially consistent with the conveying direction of the conveying rollers in the arc-shaped card collating channel are conveyed from the card collating channel outlet by the conveying rollers. The inner side and outer side of the playing cards having the lengthwise direction that is substantially inconsistent with the conveying direction of the conveying rollers in the arc-shaped card collating channel are rotated by the center rotating disc and conveying rollers until the lengthwise direction of the playing cards is substantially consistent with the conveying direction of the conveying rollers in the arc-shaped card collating channel.

Advantageous Effects of the Disclosure

The present disclosure adopts the above-mentioned technical solution. Disordered playing cards are placed in through the card feeding port and pushed to the arc-shaped card collating channel by the center rotating disc. The playing cards having the lengthwise direction that is substantially consistent with the conveying direction of the conveying rollers in the arc-shaped card collating channel are conveyed from the card collating channel outlet by the conveying rollers. The inner side and outer side of the playing cards having the lengthwise direction that is substantially inconsistent with the conveying direction of the conveying rollers in the arc-shaped card collating channel are rotated by the center rotating disc and conveying rollers until the lengthwise direction of the playing cards is substantially consistent with the conveying direction of the conveying rollers in the arc-shaped card collating channel. In this manner, the disordered playing cards are automatically sorted in a coincident direction and dealt out, automatic and efficient card collating is realized, and various main device components are reasonable in arrangement, compact in structure and high in space utilization.

Figure 1:
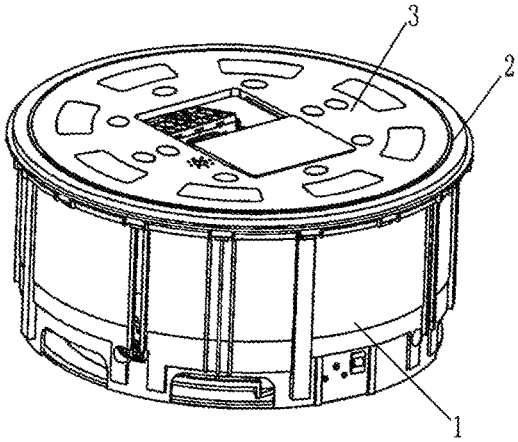
FIG. 1 is a perspective view of the poker machine of the disclosure (the core is not lifted).

Playing card 10, base 1, support roller 101, positioning roller A102, Card receiving device 20, card receptor 2, card pushing slot 21, card pushing electric motor 201, card pushing cam 2011, card pushing plate 202, card pushing roller 2021, rotating electric motor 203, guide roller 204, rotating transmission belt 205, card pushing driver 206, card pushing swing arm 207, positioning roller B208, driven wheel 209, card receiving box 210, rotating ring 211, card pushing holder 212, card raising ring 213, card blocking ring 214, Panel 3, door panel 301, card serving port 302, control disk 303, control disk panel 3031, control disk circuit board 3032, control disk base 3033, lifting guide rod 304, lifting base 305, lifting intermediate gear 306, central lifting cam 307, central lifting electric motor 308, Dealer 40, card dealing base 4, storage box 41, detection sensor 4101, card feeding protrusion 4102, card feeding channel 4103, card feeding rib 4104, card blocking plate 4105, card dealing device 42, card delivery wheel 4201, card delivery axle 42011, card distribution wheel 4202, card distribution axle 42021, first delivery wheel 4203, first delivery axle 42031, delivery bottom wall 4204, second delivery wheel 4205, second delivery axle 42051, first card discharging roller-pressing frame 4206, first card discharging press wheel 4207, first card discharging channel 4208, card flipping component 4209, card flipping axle 42091, card flipping wheel 4210, card flipping axle 42101, card flipping press wheel 4211, second card flipping press wheel 4212, second card discharging channel 4213, second card discharging roller-pressing frame 4214, card flipping channel inner side wall 4215, card pushing component 4216, second delivery press wheel 4217, delivery top wall 4218, first delivery press wheel 4219, card dealing electric motor 4220, card dealing electric motor shaft 42201, ejector rod 4221, card distributing press wheel 4222, transition wheel 4223, card flipping channel 4224, card dealing transmission belt 4225, tensioning wheel 4226, cooling fan 4227, card feeding transmission belt 4228, electromagnet 4229, card flipping electric motor 4230, card flipping electric motor shaft 42301, conveyor transmission belt 4231, card flipping transmission belt 4232, connecting rod 4233, crank 4234, first sensor 4235, second sensor 4236, third sensor 4237, camera 4238, card flipping channel outer side wall 4239, rotating member 4240, thickness measuring wheel 4241, thickness measuring sensor 4242, thickness measuring delivery wheel 4243, Lifting driver 5, lifting electric motor 501, lifting protrusion 502, lifting swing arm 503, lifting electric motor bracket 504, lifting cam 505, lifting slot 506, Card collating device 6, upper casing 601, card collating base 602, card collating channel outer side wall 603, outer electric motor 604, conveying rollers 605, center rotating disc 606, rotating disk upper tapered surface 6061, rotating disc card pushing slope 6062, rotating disk side wall 6063, card discharging baffle 607, outer support roller 608, rotating disc electric motor 609, card collating channel outlet 610.

DESCRIPTION OF EMBODIMENTS

The embodiments of the present disclosure are described in detail below. Examples of the embodiments are shown in the accompanying drawings, wherein the same or similar reference numerals indicate the same or similar elements or elements with the same or similar functions. The embodiments described below with reference to the accompanying drawings are exemplary, and are intended to explain the present disclosure, but should not be construed as limiting the present disclosure.

In the description of the present disclosure, it should be understood that the orientation or positional relationship indicated by "center", "longitudinal", "transverse", "length", "width", "thickness", "upper", "lower", "front", "rear", "left", "right", "vertical", "horizontal", "top", "bottom", "inner", "clockwise", and "counterclockwise" are adopted based on the orientation or position relationship shown in the figure, and are only for the convenience of describing the present disclosure and simplifying the description, rather than indicating or implying that the device or element referred to must be set at a specific orientation, be constructed and operated in a specific orientation, and therefore cannot be construed as a limitation to the disclosure.

In addition, the terms "first" and "second" are only used for descriptive purposes, and should not be construed as indicating or implying relative importance or implicitly indicating the number of indicated technical features. Thus, the features defined with "first" and "second" may explicitly or implicitly include one or more of these features. In the description of the present disclosure, unless otherwise specified, "plurality" means two or more than two, unless specifically defined otherwise.

In the present disclosure, unless otherwise clearly specified and limited, the terms "arranged", "connected", "linked", "fixed" and other terms should be understood in a broad sense, for example, there can be a fixed connection or a detachable connection, or integrally connected; there can be a mechanical connection or an electrical connection; there can be direct connection or indirect connection formed through an intermediate media, and can be an internal connection between two components. For those of ordinary skill in the art, the specific meaning of the above-mentioned terms in the present disclosure can be understood according to specific circumstances.

In the present disclosure, unless otherwise clearly defined and limited, the recitation that the first feature is "above" or "below" the second feature may include direct contact between the first and second features, or may include that the first and second features are not in direct contact but they are in contact through additional features between them. The recitation that the first feature is "on", "above" and "upon" the second feature involves that the first feature is right above and obliquely above the second feature, or simply means that the level of the first feature is higher than the second feature. The recitation that the first feature is "below", "under" and "underneath" the second feature includes that the first feature is directly below and obliquely below the second feature, or simply means that the level of the first feature is lower than the second feature.

Embodiment 1

A poker machine as shown in FIG. 1 to FIG. 4 includes a base 1 and a core. The core is mounted on the base or inside the base. The core includes a card receptor 2 and a dealer. The core is driven to move up and down on the base 1 through a lifting drive mechanism. The dealer is arranged in the center of the card receptor 2 and driven to rotate relative to the card receptor 2 through a rotary drive mechanism. The dealer includes a storage box 41 and a card dealing device 42, and a plurality of card receiving positions are arranged around the dealer on the card receptor 2. The top of the card receptor 2 is provided with a panel 3, and the panel 3 is provided with a card feeding hole. A door panel 301 and its drive mechanism are arranged on the card feeding hole, and a storage box 41 is arranged under the card feeding hole.

Figure 2:
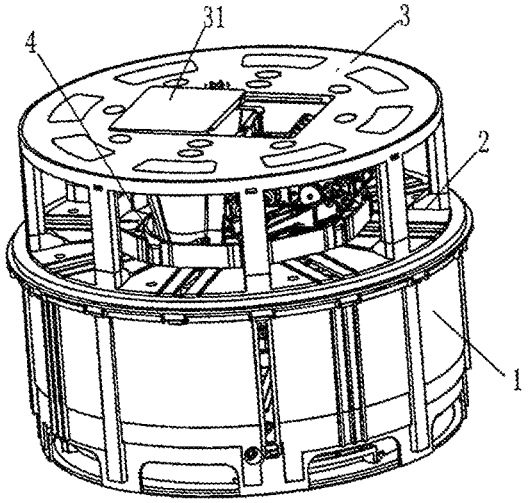
FIG. 2 is a perspective view of the poker machine of the disclosure (the core is lifted).
Figure 3:
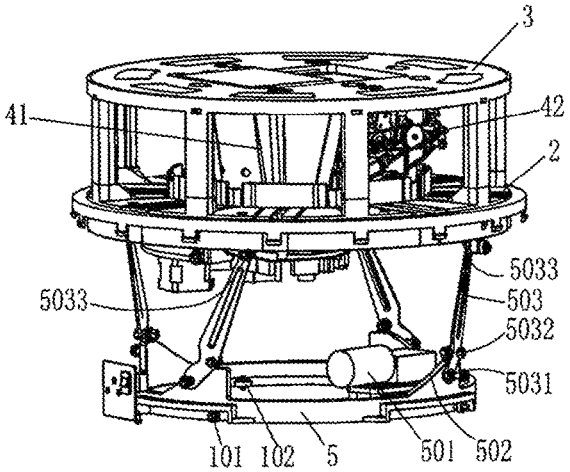
FIG. 3 is a perspective view of the poker machine of the disclosure (the core is lifted, the base is omitted).
Figure 4:
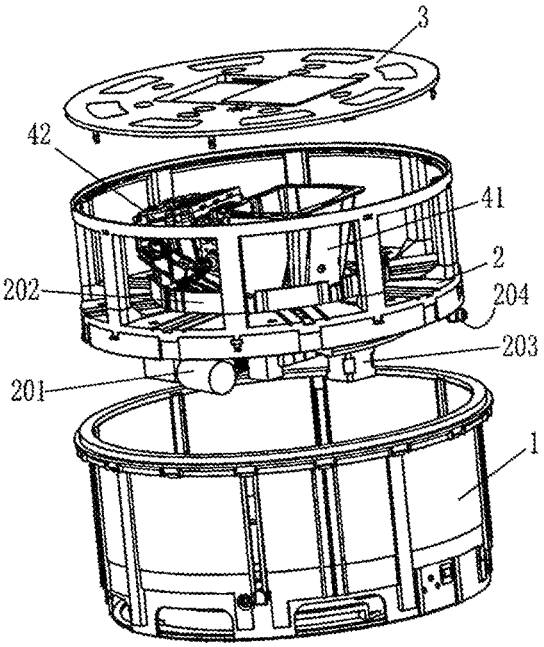
FIG. 4 is an exploded view of the poker machine of the disclosure.

As shown in FIG. 2 and FIG. 3, in this embodiment, the base 1 includes a circular bottom plate and a barrel-shaped side wall. A power supply and its power switch are disposed on the base, and a lifting drive mechanism for driving the core to move up and down is disposed on the base. The distributed playing cards are placed on the card receptor 2 of the core.

The poker machine can be placed on the desktop as an independent machine for players to use. In this scenario, the poker machine does not have a lifting drive mechanism (the base and the card receptor are integrated), but a plurality of openings are provided on the side wall of the base for players to take playing cards. Most of the time, this poker machine is embedded in the center hole of the card table, and only the panel 3 is exposed and aligned with the table, so that the poker machine does not interfere with the games. Besides, the poker machine is easy to manufacture, dispose and maintain. In the scenario, a lifting drive mechanism needs to be provided on the base to drive the distributed playing cards of all parties to rise so that the players can take the playing cards. It should be noted that the base and the card receptor of the disclosure are not limited to a cylindrical shape, and can also be in a square column shape, a polygonal column shape, a plum column shape, a tapered shape, and various other shapes.

In this embodiment, the panel 3 is provided with buttons for controlling actions such as starting, shuffling, dealing cards, and core raising and lowering. When playing cards, the player can set playing rules on the control panel. The poker machine distributes cards to each player according to the set playing rules. When the cards are dealt, each player's playing cards are randomly distributed by the dealer that is driven by the rotary drive mechanism to rotate randomly. The cards are intermittently distributed to the card receiving position of each player on the card receptor according to the number of cards set by the player. The door panel 301 and its drive mechanism are disposed on the panel 3. The structures of the door panel 301 and its drive mechanism can be derived from various structures disclosed in patent documents such as CN103157272 and CN108525278.

As shown in FIG. 3 to FIG. 8, in this embodiment, the card receptor 2 and the base 1 are not fixed and can be moved up and down. The card receptor and the base can be configured to move up and down through the cooperation of a plurality of guide posts and guide sleeves or slots and blocks arranged around them. A plurality of guide rollers 204 are provided around the card receptor 2 to match the guide grooves on the side wall of the base 1 to realize the up-down movement of the card receptor 2. The panel 3 is fixed on the top of card receptor 2. There are multiple openings on the side walls around the card receptor 2. When card receptor 2 drops to the bottom, the panel 3 matches the desktop of the poker table. When the card receptor 2 is fully raised, the bottom wall of the plurality of openings on the side walls around the card receptor 2 matches the desktop of the poker table. The dealer is disposed in the center of the card receptor. Multiple card receiving positions are set around the dealer on the card receptor 2. The card receiving positions correspond to the openings. Each card receiving position is provided with a card pushing plate 202 and a card pushing slot 21. The card pushing plate 202 is reciprocated by the card pushing drive mechanism from the inner side to the outer side of the card receiving position. When the dealer is dealing cards, the card pushing plate 202 moves to the inner side of the card receiving position close to the dealer, and the playing cards are sent to the card receiving position. When the core rises to the desktop, the card pushing plate 202 moves from the inside to the outside along the card pushing slot 21 to push the playing cards on the card receiving position out of the core to the desktop. The card pushing slot 21 extends from the inside to the outside of the card receiving position, and the card pushing slot 21 is preferably arranged radially along the circumference of the card receptor.

Figure 20:
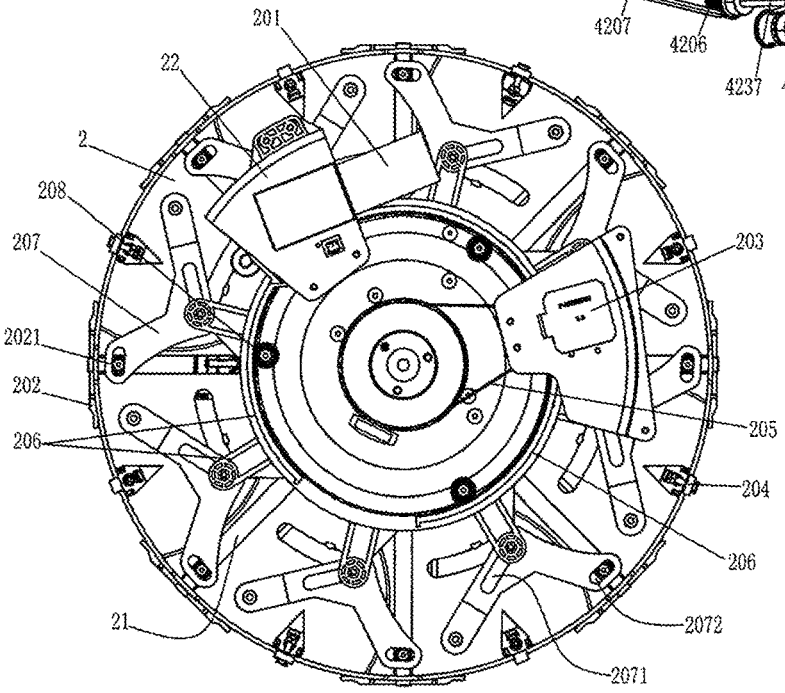
FIG. 20 is a bottom view of the card receptor of the disclosure (the card pushing plate pushes).
Figure 21:
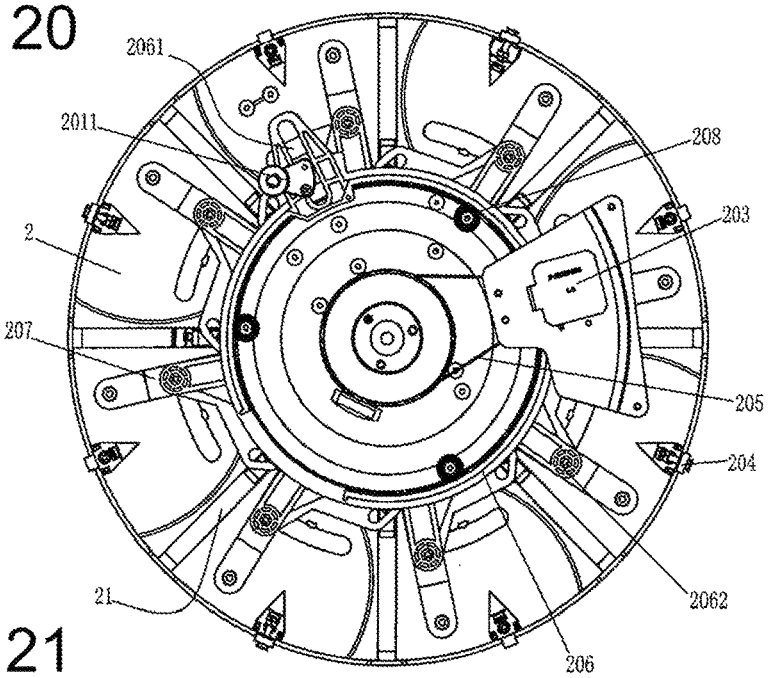
FIG. 21 is a bottom view of the card receptor of the disclosure (the card pushing plate does not push).

As shown in FIG. 20 and FIG. 21, the card pushing drive mechanism is arranged under the card receptor 2, and includes a card pushing electric motor 201, a card pushing driver 206, and a plurality of card pushing swing arms 207 corresponding to the plurality of card pushing plates 202 one-to-one. The card pushing driver 206 is in a circular ring shape. The card pushing driver 206 is mounted at the bottom of the card receptor 2 through a plurality of positioning rollers B208 and is driven to rotate by the card pushing electric motor 201. Multiple driving parts corresponding to the multiple card pushing swing arms 207 are extended from the outer circumference of the card pushing driver 206. One driving part is movably connected with the middle part of one card pushing swing arm 207 through the slot A2071, and one end of the card pushing swing arm 207 is movably connected (hinged) with the bottom of the card receptor 2. The other end of the card pushing swing arm 207 is movably connected to the bottom of the card pushing plate 202 through the slot B2072 and the card pushing roller 2021, so that the card pushing driver 206 pushes each card pushing arm 207 to rotate, thereby pushing the card pushing plate 202 to perform the pushing action from the inner side to the outer side of the card receiving position or to reciprocate from the outer side to the inner side of the card receiving position. The card pushing driver drives multiple card pushing plates simultaneously, has a simple structure, reasonable action, reliable operation and low manufacturing cost. The card pushing swing arm 207 is in the shape of a V-shaped return sign. The card pushing electric motor 201 drives the card pushing driver 206 to rotate through the matching structure of gears and ring gears, or the card pushing electric motor 201 drives the card pushing driver 206 to rotate through the matching structure of the card pushing cam 2011 and the slot 2061.

Figure 6:
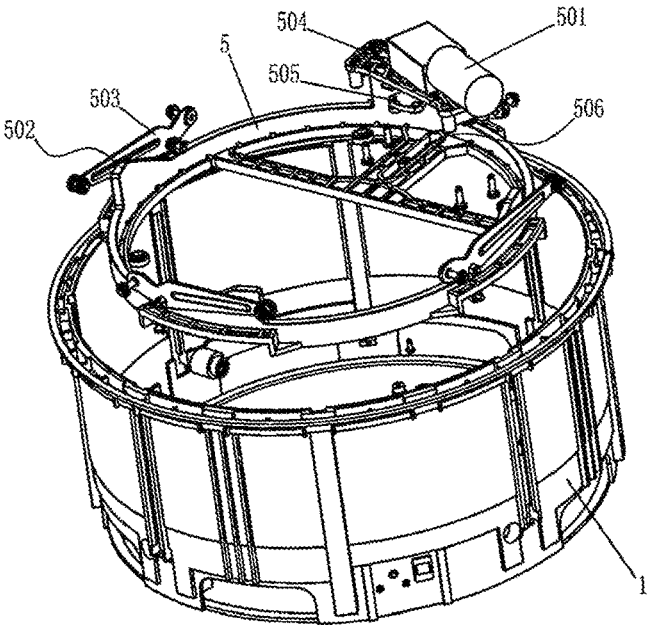
FIG. 6 is an exploded view of the base and core lifting mechanism of the disclosure.
Figure 7:
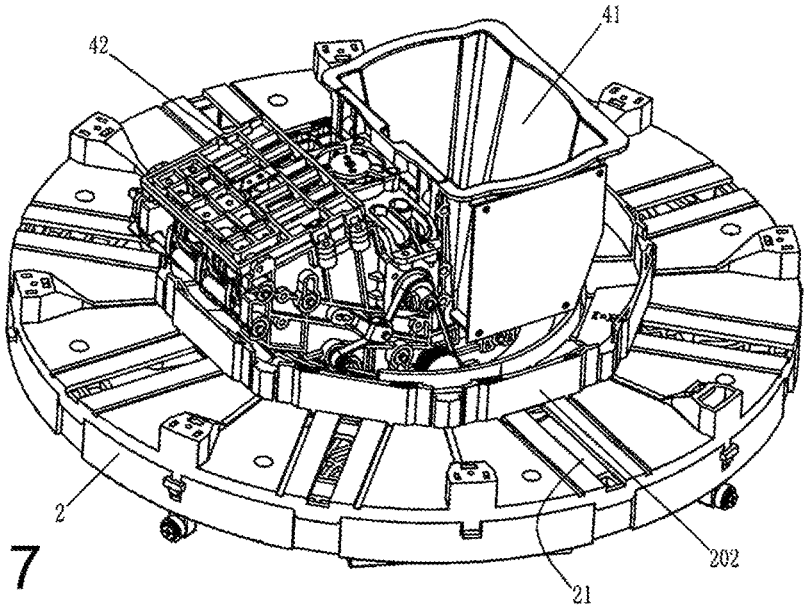
FIG. 7 is a perspective view of the core of the poker machine of the disclosure (the card pushing plate does not push out).
Figure 8:
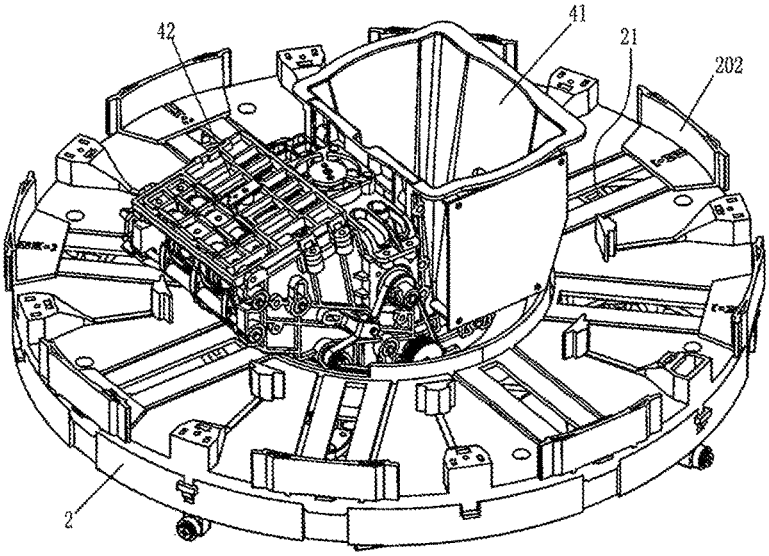
FIG. 8 is a perspective view of the core of the poker machine of the disclosure (the card pushing plate pushes out).
Figure 22:
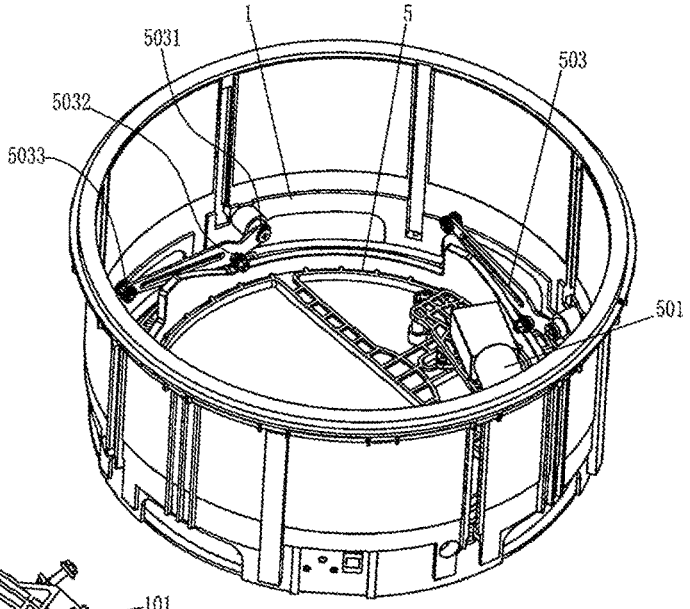
FIG. 22 is a schematic view of the structure of the base of the disclosure.
Figure 23:
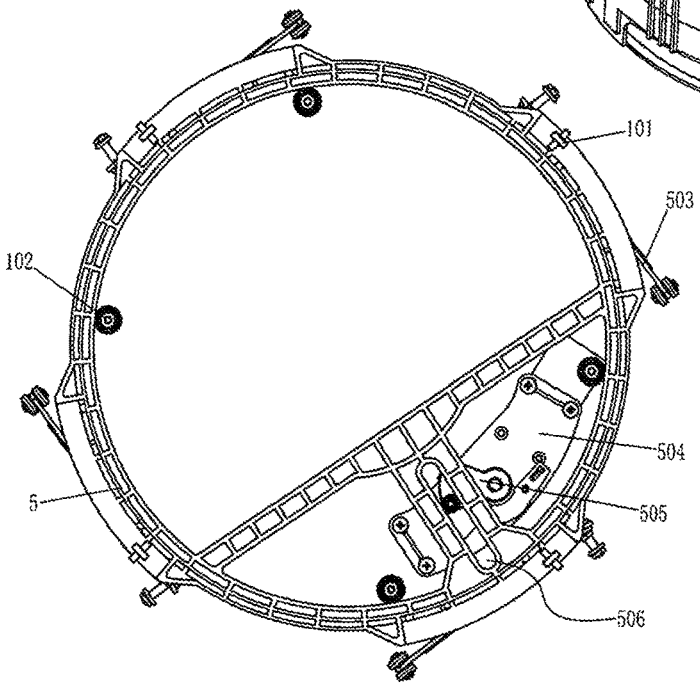
FIG. 23 is a schematic view of the structure of the core lifting mechanism of the disclosure.

As shown in FIG. 3 and FIG. 6, the lifting drive mechanism includes a lifting driver 5, a lifting electric motor 501 and a plurality of lifting swing arms 503. The multiple lifting swing arms 503 are evenly distributed under the card receptor 2 of the core. One end 5031 of the lifting swing arms 503 is hinged to the base 1, and the other end 5033 of the lifting swing arms 503 abuts against the bottom of the card receptor 2 of the core. The lifting swing arm 503 is driven by the lifting electric motor 501 through the lifting driver 5 to drive the multiple lifting swing arms 503 to swing simultaneously to push the core to move up and down. In this embodiment, the lifting driver 5 has a circular ring shape, and the top of the circumference of the ring is provided with a plurality of lifting protrusions 502 corresponding to the plurality of lifting swing arms 503. The lifting protrusions 502 abut against the support rollers 5032 in the middle of the lifting swing arms 503. The lifting driver 5 is disposed on the base 1 through the support roller 101 and the positioning roller 102 so as to rotate around the center of rotation. In this embodiment, a plurality of support rollers 101 are arranged outside the ring of the lifting driver, and there is a groove that matches the lifting driver so as to limit the rotation range of the lifting driver 5. A plurality of positioning rollers 102 are disposed on the inner side of the ring of the lifting driver 5 to achieve the function of positioning the center of rotation of the lifting driver. When the lifting driver 5 rotates under the driving of the lifting electric motor 501, the support rollers 5032 in the middle of the plurality of lifting swing arms 503 respectively move along the corresponding lifting protrusions 502 on the lifting driver 5, so that the lifting protrusions 502 push the lifting swing arms 503 to swing. Accordingly, the lifting swing arms 503 and one end 5033 that abuts against the bottom of the core can move up and down, and the up-down movement of the core can be realized. As shown in FIG. 22 and FIG. 23, in this embodiment, the lifting electric motor 501 is disposed on the base 1 through the lifting electric motor bracket 504, and the output axle of the lifting electric motor 501 (or the output axle of the deceleration mechanism connected to the lifting electric motor) is provided with a lifting cam 505 that rotates horizontally. The lifting cam 505 is slidably fitted with the lifting slot 506 on the lifting driver 5 through rollers, so as to drive the lifting driver 5 to rotate. In other embodiments, the lifting electric motor can further drive the lifting driver to rotate through the internal or external meshing of the driving gear and the gear ring.

Figure 5:
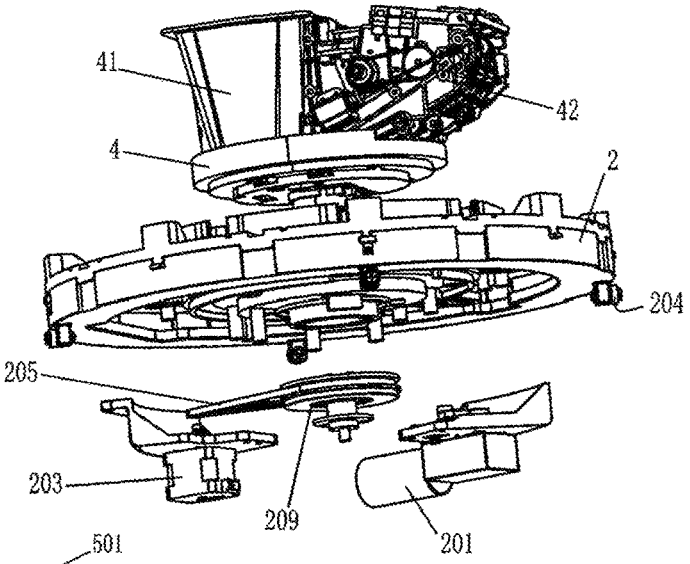
FIG. 5 is an exploded view of the core of the poker machine of the disclosure.
Figure 9:
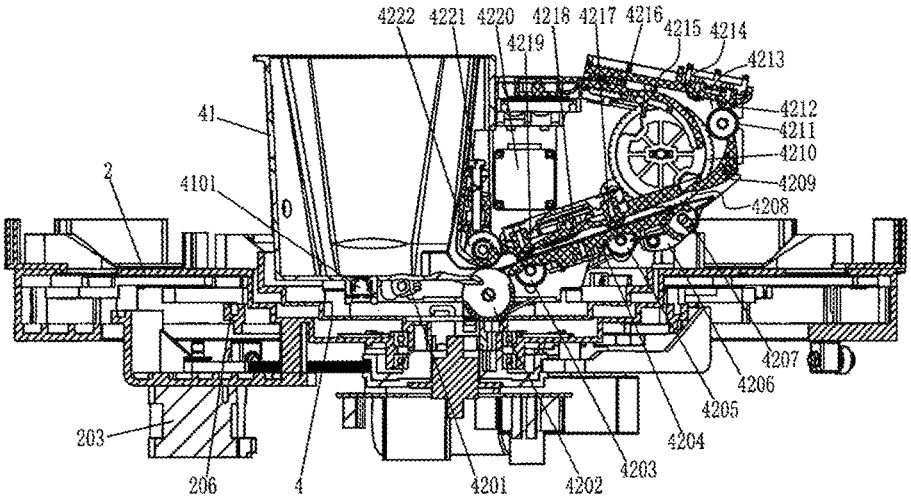
FIG. 9 is a cross-sectional view of the core of the poker machine of the disclosure.
Figure 10:
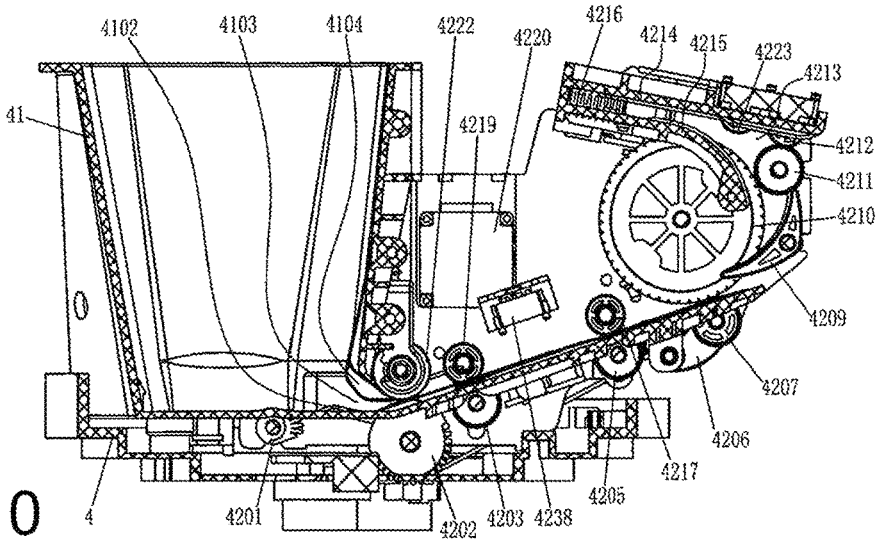
FIG. 10 is a first cross-sectional view of the dealer of the disclosure (direct dealing status).

As shown in FIG. 4, FIG. 5, FIG. 7, and FIG. 8, the dealer is fixed on the card holder 4, which is mounted on the center of the upper part of the card receptor 2 through a bearing rotation and driven to rotate by a rotary drive mechanism, as shown in FIG. 5 and FIG. 9. The rotary drive mechanism includes a rotating electric motor 203 disposed at the bottom of the card receptor 2 and a driven wheel 209 that is fixed and synchronously rotated with the card holder 4 in the circumferential direction. The rotating electric motor 203 drives the driven wheel 209 through the rotating transmission belt 205 to drive the card holder 4 to rotate.

As shown in FIG. 9 to FIG. 15, the dealer includes a storage box 41 and a card dealing device 42. The storage box 41 and the card dealing device 42 are located on the left and right sides of the card holder 4, respectively. One side of the bottom of the storage box 41 is connected to the card feeding channel of the card dealing device 42. In this embodiment, the storage box is used to place the organized playing cards in a stack, and the bottom of the storage box 41 is equipped with a detection sensor 4101 for detecting whether there are playing cards and a card delivery wheel 4201 that pushes the playing cards to the card feeding channel of the card dealing device 42. A side wall of the storage box 41 close to the card feeding channel of the card dealing device 42 is provided with a card blocking plate 4105. The card blocking plate 4105 is provided with a plurality of card feeding ribs 4104. A card distributing wheel 4202 of the card dealing device 42 is arranged below the card feeding rib 4104. A plurality of card feeding protrusions 4102 are formed on the inner wall of the bottom of the storage box 41 between the card delivery wheel 4201 and the card distributing wheel 4202, so that the card feeding channel 4103 of the card dealing device 42 is formed between these card feeding protrusions 4102 and card feeding ribs 4104. In this way, the card feeding channel formed with matching concaves and convexes helps to rub and separate multiple overlapping playing cards. More preferably, a plurality of card feeding protrusions 4102 and a plurality of card feeding ribs 4104 are alternately arranged in a staggered manner to achieve a better card-rubbing and separating effect.

The card dealing device 42 includes a card distributing mechanism, a delivery mechanism, and a card flipping mechanism. The channel for the playing cards to pass through in the card dealing device 42 includes the card feeding channel 4103, the delivery channel, the card flipping channel 4224, the first card discharging channel 4208, and the second card discharging channel 4213. A card flipping component 4209 for opening or closing the card flipping channel 4224 or the outlet of the first card discharging channel 4208 is provided near the first card discharging channel 4208. When the card flipping component 4209 closes the card flipping channel 4224 or opens the outlet of the first card discharging channel 4208, the card feeding channel 4103, the delivery channel, and the first card discharging channel 4208 are connected in sequence. When the card flipping component 4209 opens the card flipping channel 4224 and closes the outlet of the first card discharging channel 4208, the card feeding channel 4103, the delivery channel, the first card discharging channel 4208, the card flipping channel 4224 and the second card discharging channel 4213 are connected in sequence. The card distributing mechanism is disposed at the card feeding channel of the card dealing device 42, the delivery mechanism is disposed at the delivery channel, and the card flipping mechanism is disposed between the first card discharging channel 4208 and the second card discharging channel 4213.

The card distributing mechanism can adopt various card distributing structures disclosed in patent documents such as CN108525278A, CN105854274A, etc. However, although these card distributing structures can better separate the fed playing cards to ensure that single pieces of them pass through, it is difficult to make the playing cards that have entered the delivery channel to withdraw (rejected) from the card feeding channel. As such, when the sensor subsequently detects that two playing cards are overlapped and it is necessary to reject the playing cards from the card feeding channel for card distribution again, the problem of rejecting card arises. In order to overcome the technical problem, in the embodiment, the structure of the card distributing mechanism is preferably as follows.

As shown in FIG. 9 to FIG. 12, the card distributing mechanism includes a card blocking plate 4105, a card delivery wheel 4201, a card distribution wheel 4202, and a card distributing press wheel 4222. The card delivery wheel 4201 used to push playing cards to the card feeding channel of the card dealing device 42 is disposed at the bottom of the storage box 41, the bottom of the card blocking plate 4105 is provided with the card distributing press wheel 4222. The card distribution wheel 4202 is arranged under the card distributing press wheel 4222. The card distribution wheel 4202 is driven to rotate by the card dealing electric motor. The card distributing press wheel 4222 achieves the effect of non-rotating during card feeding and rotating during card rejecting through the one-way clutch mechanism. In this way, not only that the cards can be effectively distributed rapidly when cards are fed in, and when the cards need to be rejected, the card distributing press wheel 4222 can cooperate with the card distribution wheel 4202 to rotate inversely to reject card in a fast and reliable manner, thus avoiding the difficulty of rejecting cards. More preferably, the card distributing press wheel 4222 and the card distributing wheel 4202 are not located on the same side but they are overlapped in the up-down direction (that is, the axis of the card distributing press wheel 4222 and the axis of the card distributing wheel 4202 are misaligned by a horizontal distance, and the axis of the card distributing press wheel 4222 is closer to the storage space of the storage box 41 than the axis of the card distributing wheel 4202. The lowest part of the card distributing press wheel 4222 is lower than the high part of the card distributing wheel 4202). In this way, when there are a plurality of playing cards fed in the gap between the card distributing press wheel 4222 and the card distributing wheel 4202, the feeding end of the playing cards are tilted, such that the overlapping playing cards are misaligned. As such, it is possible to prevent the overlapping playing cards from adhered to each other and cannot be separated because of static electricity. Since the card distributing press wheel 4222 is non-rotatable through the control of the one-way clutch mechanism, the static friction force between the card distributing press wheel 4222 and the playing cards thereon is much greater than the friction force between the overlapping playing cards, and the transmission driving force of the playing cards is applied by the card distributing wheel 4202, and the force is applied to the lower playing card, the lower playing card is delivered to move forward continuously, and the upper playing card is retained temporarily. The overlapping cards are separated, the separating speed is fast, the structure is simple, maintenance is convenient, and accuracy is high.

In order to further improve the card distributing effect of the card distributing mechanism, the bottom of the card blocking plate 4105 is provided with a plurality card feeding ribs 4104. A plurality of card feeding protrusions 4102 are formed on the inner wall of the bottom of the storage box 41 between the card delivery wheel 4201 and the card distribution wheel 4202. The card feeding ribs 4104 are closer to the card distributing press wheel 4222 with respect to the card feeding protrusions 4102. In this way, the card feeding channel 4103 of the card dealing device 42 is formed between the card feeding protrusions 4102, the card feeding ribs 4104 and the card distribution wheel 4202. The card feeding channel 4103 is a recessed structure with two ends titled (the card feeding protrusions 4102 and card distribution wheel 4202) and the middle part recessed. Such card feeding channel formed with matching concaves and convexes helps to rub and separate multiple overlapping playing cards, thereby ensuring that the multiple playing cards that enter the card distribution wheel 4202 and the card distributing press wheel 4222 are separated in the front-back direction. Additionally, since the card feeding protrusion 4102 erects the playing cards in the storage box 41 outside the card feeding channel 4103, when the playing cards are rejected, the playing cards that are rejected from the card feeding channel will be inserted under the playing cards in the storage box 41, so it is possible to prevent two overlapping cards from abutting against each other and result in difficulty in rejecting cards. More preferably, the plurality of card feeding protrusions 4102 and the plurality of card feeding ribs 4104 are arranged in a staggered manner alternatively, so as to achieve a better card-rubbing and separating effect.

Figure 16:
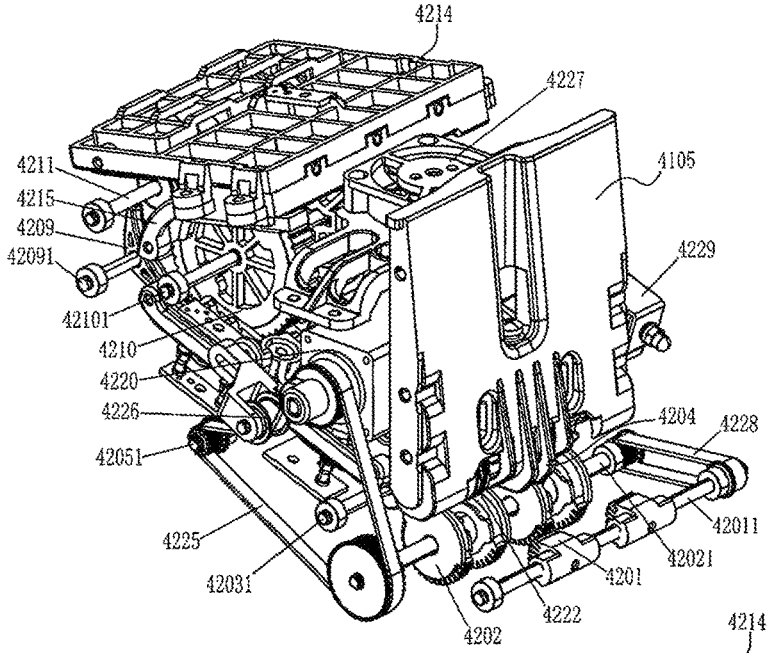
FIG. 16 is a first perspective view of the card dealing device of the disclosure (a part of casing is omitted).
Figure 17:
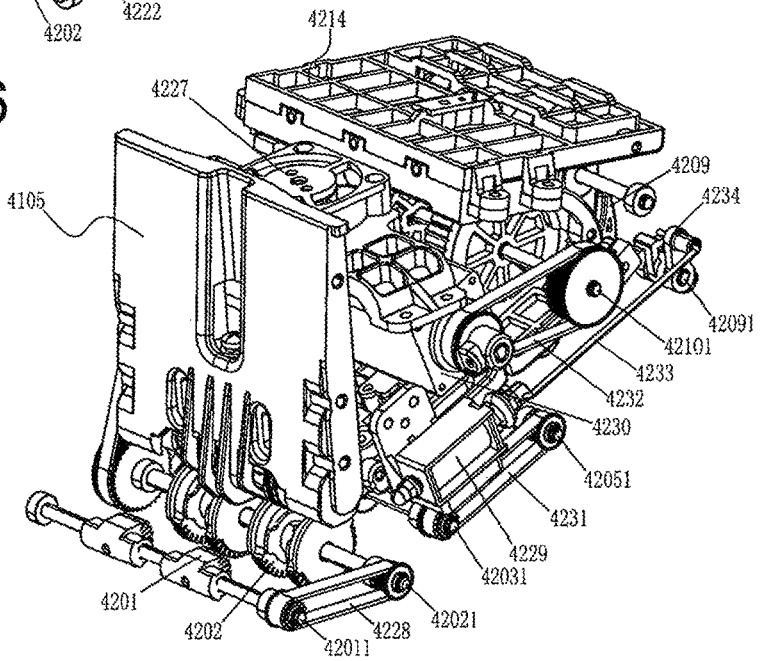
FIG. 17 is a second perspective view of the card dealing device of the disclosure (a part of casing is omitted).
Figure 18:
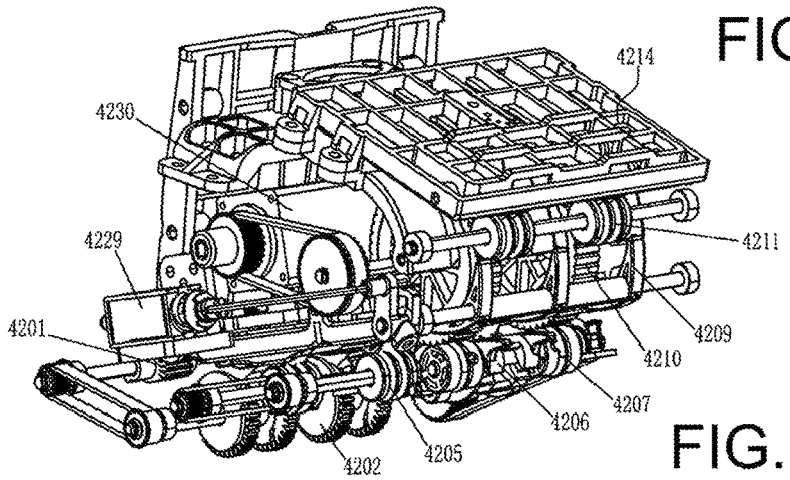
FIG. 18 is a third perspective view of the card dealing device of the disclosure (a part of casing is omitted).

In this embodiment, one side of the card delivery wheel 4201 is protrudingly formed with arc-shaped zigzags, so that during the rotation of the card delivery wheel 4201, the playing cards can be pushed upward and forward, so that the playing cards can better leap over the card feeding protrusions 4102. In addition, this action can also prevent the playing cards in the front-back direction from abutting against each other and jammed when the card dealing device rejects the cards. The card distributing press wheel 4222 is passively driven to rotate in a single direction. For the convenience of adjustment, the card distributing press wheel 4222 is disposed at the bottom of the card blocking plate 4105 through an elastic pressing mechanism. The elastic pressing mechanism is a compression spring and an ejector rod 4221. The one-way clutch mechanism is a one-way clutch mounted on the axle of the card distributing press wheel 4222. The card distributing wheel, the card delivery wheel, and the card distributing press wheel each may be a roller part, or can be composed of multiple wheel-shaped parts mounted on the same axle, for example, as shown in the FIG. 16 and FIG. 17. Each card distribution wheel 4202 includes a support frame with a certain rigidity and a rubber ring sleeved and fixed on the support frame. Part of the arc-shaped circumference of the rubber ring is an arc-shaped rubber zigzags that are protruded for contacting the playing cards. Part of the circumference excluding the arc-shaped rubber zigzags of the rubber ring is lower than the circumference of the side wall of the support frame. In this way, when the friction force that is generated due to the contact between the arc-shaped rubber zigzags of the card distributing wheel and the playing cards is large, it is easier to drive the playing card to move. When the friction force that is generated due to the contact between the circumference of the side wall of the support frame of the card distributing wheel and the playing cards is small, it is difficult to drive the playing card to move. The playing cards are driven intermittently to move so as to help two playing cards to separate. Four card distributing wheels 4202 are disposed on the same card distribution axle 42021. The card feeding ribs 4104 at the bottom of the card blocking plate 4105 and the card distributing press wheel 4222 are arranged at different positions with respect to the four card distributing wheels 4202 and configured in a staggered manner alternately. In this way, it is convenient to adjust the gap in the up-down direction, so as to separate cards rapidly and effectively. The card delivery axle 42011 of the card delivery wheel 4201 and the card distribution axle 42021 of the card distribution wheel 4202 are drivenly connected through the card feeding transmission belt 4228, so as to realize matching and rotation of the card delivery wheel 4201 and the card distribution wheel 4202, thereby increasing card distributing efficiency and card separating effect.

As shown in FIG. 9 to FIG. 12, the delivery mechanism includes a first delivery wheel 4203 and a second delivery wheel 4205 disposed on the delivery bottom wall 4204 of the delivery channel, as well as the first delivery press wheel 4219 and the second delivery press wheel 4217 disposed on the delivery top wall 4218 of the delivery channel. The first delivery press wheel 4219 and the first delivery wheel 4203 match each other in the up-down direction, the second delivery press wheel 4217 and the second delivery wheel 4205 match each other in the up-down direction. The first delivery press wheel 4219 and the second delivery press wheel 4217 are driven wheels, the first delivery wheel 4203 and the second delivery wheel 4205 are driving wheels and are sleeved with rubber rings to increase friction. The first delivery axle 42031 of the first delivery wheel 4203, the second delivery axle 42051 of the second delivery wheel 4205, the card distribution axle 42021 of the card distribution wheel 4202 and the card distribution axle 42021 of the card dealing electric motor 4220 are drivenly connected through the card dealing transmission belt 4225. The card dealing transmission belt 4225 is tensioned by the tensioning wheel 4226, thereby realizing synchronized movement of card feeding, card distribution and card delivery. The first delivery wheel 4203, the second delivery wheel 4205, the first delivery press wheel 4219 and the second delivery press wheel 4217 can be press-fitted face-to-face in the up-down direction, or can be matched in a misaligned manner in the up-down direction. Each of them can be a roller-shaped part, or can be composed of multiple wheel-shaped parts mounted on the same axle.

Figure 13:
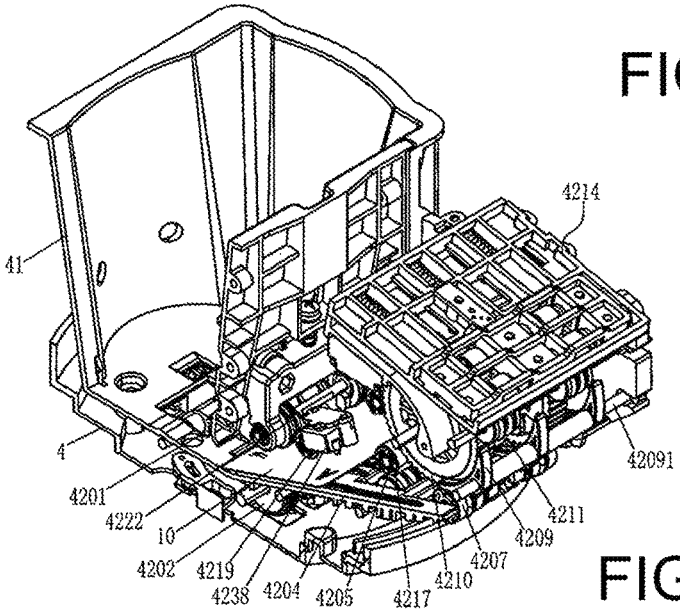
FIG. 13 is a partial sectional perspective view of the dealer of the disclosure.
Figure 14:
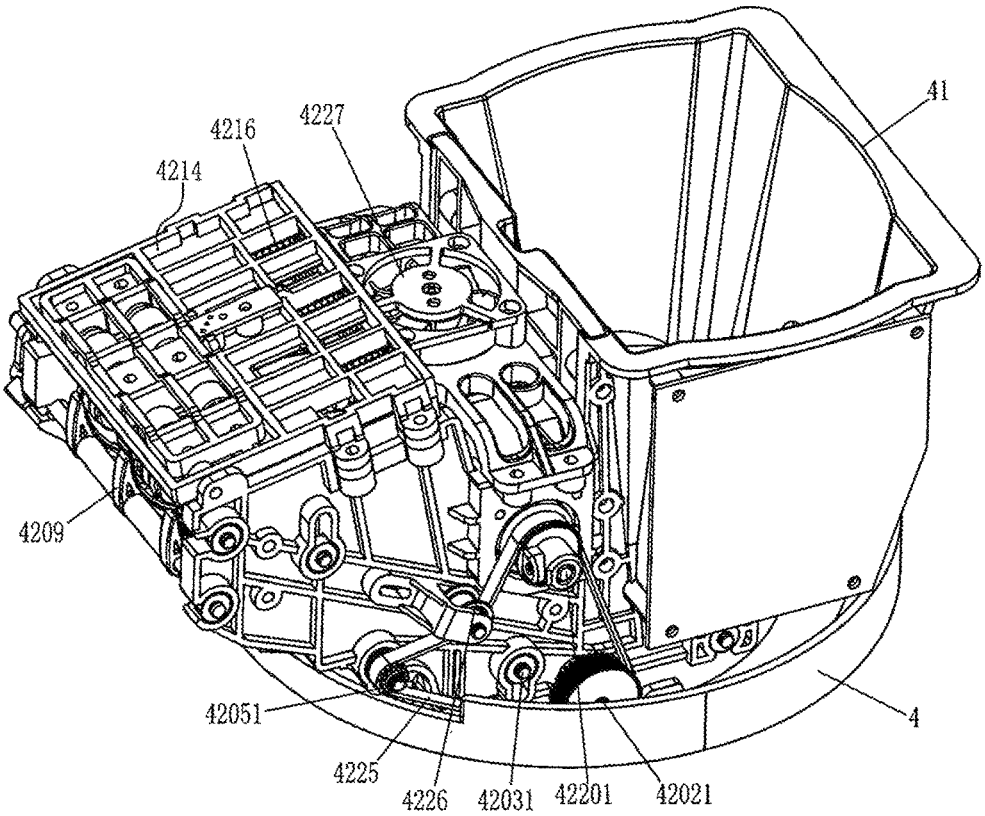
FIG. 14 is a first perspective view of the dealer of the disclosure.
Figure 19:
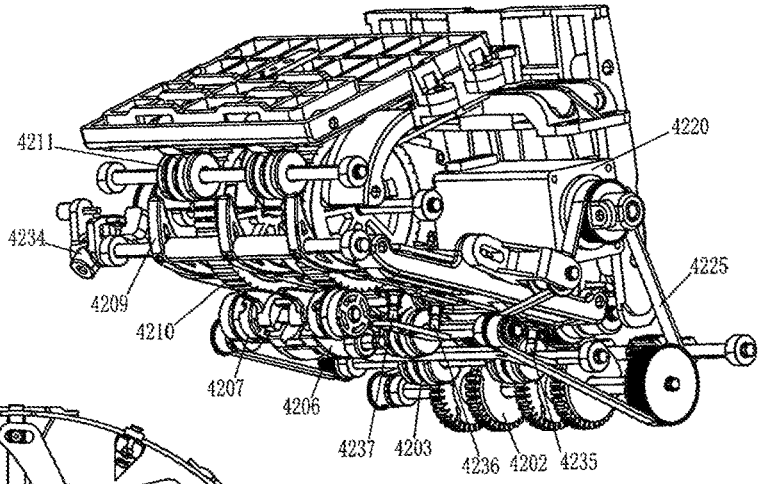
FIG. 19 is a fourth perspective view of the card dealing device of the disclosure (a part of casing is omitted).

As shown in FIG. 13 and FIG. 19, the delivery channel of the dealer is provided with an identification element for identifying the front and back sides of a playing card and a plurality of detection elements for detecting the playing card.

Regarding the identification of the front and back sides of the playing cards in the delivery channel: one method is to obtain the photo information of different positions on the same side of the playing cards. The pattern on the back of the playing card is a regular unit pattern that has high coincidence of each continuous position at four corners. Based on the level of coincidence of the patterns in the photos, the front side and back side of the playing card can be identified. Another method is performed based on the characteristic that a symbol is always shown at a fixed position in the oblique corner of the front side of the playing card, through the symbol shown at the fixed position in the oblique corner of the playing card, the front side and back side of the playing card can be identified. For example, please refer to Kou Yongjun's master's thesis titled "Application Research of Image Recognition on Card Dealing Machine" published in Hunan University Journal in 2007. Another method is performed by printing magnetic ink at a fixed position on the front or back side of the playing card, and the front or back side of the playing card can be identified through detecting the magnetic ink. In the first two identification methods described above, the identification element is a camera. In the third identification method, the identification element is a magnetic detection sensor.

To identify whether the playing cards in the delivery channel overlap each other: one method is to detect the length of the playing cards. When the detecting element detects that the playing cards in the delivery channel are longer than the normal length, it can be determined that there are multiple playing cards overlapping each other. Another method is to detect the thickness of the playing cards. When the detecting element detects that the thickness of the playing cards in the card feeding channel, the delivery channel or the first card discharging channel is greater than the normal thickness, it can be determined that there are multiple playing cards overlapping each other. One or more methods can be adopted in the same card dealing device.

When it is determined that the playing cards in the delivery channel do not need to be flipped, the card flipping mechanism will deal the playing cards directly; when it is determined that the playing cards in the delivery channel need to be flipped, the card flipping mechanism will flip the playing cards and deal it. When it is determined that the playing cards need to be rejected from the card dealing device, the card dealing electric motor 4220 drives the first delivery wheel 4203, the second delivery wheel 4205, the card distributing wheel 4202, and the card delivery wheel 4201 to reverse the card to implement the withdrawal. One or more methods can be adopted in the same card dealing device.

The disclosure identifies the front and back sides of the playing cards in the delivery channel, and flips the playing cards in the card flipping channel. The above two steps do not interfere each other, and the cards can be flipped and dealt in a continuous manner, which greatly improves the card flipping efficiency and card dealing efficiency.

As shown in FIG. 13, in this embodiment, the identification element used to identify the front and back sides of the playing card is a camera 4238. The camera 4238 and a detection sensor for detecting the presence of the playing cards are fixed on the delivery bottom wall 4204 or the delivery top wall 4218 of the delivery channel. When the detection sensor detects a playing card, the camera is activated at the same time or delayed, so that the camera can capture right on time the pattern information at the fixed position in the oblique corner of the playing card in the delivery channel. As such, the controller can identify the front or back side of the playing card according to the pattern information, for example, when the symbol pattern is identified, it can be determined that the front side of the playing card is identified.

In order to ensure that the camera can be activated in time and take a panoramic view of the symbol patterns on the playing cards, the following settings are preferred:

In the first case, the playing cards are delivered forward along the widthwise side in the card dealing device (that is, the width of the delivery channel is similar to the width of the playing cards). In this way, the preferred value range of the width B of the delivery channel is: width of playing card+1 mm<B<width of playing card+5 mm.

The value range of the vertical distance M between the center of the camera lens and the left or right side wall of its adjacent delivery channel is: the vertical distance between the symbol pattern of a playing card and its adjacent lateral edge<M< the vertical distance between the symbol pattern of a playing card and its adjacent lateral edge+5 mm.

The value range of the vertical distance H between the center of the camera lens and the playing cards in the delivery channel is: 10 mm<H<15 mm.

Take the commonly used playing cards (Bridge Size is 8.8 cm long and 5.7 cm wide) as an example, 58 mm<B<62 mm, 6 mm<M<12 mm.

In the second case, the playing cards are delivered along the lengthwise side in the card dealing device (that is, the width of the delivery channel is similar to the length of the playing cards). In this way, the preferred value range of the width B of the delivery channel is: playing card length+1 mm<B<playing card length+5 mm.

The value range of the vertical distance M between the center of the camera lens and the left or right side wall of its adjacent delivery channel is: the vertical distance between the symbol pattern of a playing card and its adjacent lateral edge<M< the vertical distance between the symbol pattern of a playing card and its adjacent lateral edge+5 mm.

The value range of the vertical distance H between the center of the camera lens and the playing cards in the delivery channel is: 10 mm<H<15 mm.

Take the commonly used playing cards (Bridge Size is 8.8 cm long and 5.7 cm wide) as an example, 89 mm<B<93 mm, 6 mm<M<12 mm.

In other embodiments, the playing cards in the delivery channel can be delivered in the manner of closing to either the left side or the right side through a specific delivery method, speed and direction, so that the width of the delivery channel will not interfere with the setting of the camera. It is only necessary to limit that: the value range of the vertical distance M between the center of the camera lens and the left or right side wall of its adjacent delivery channel is: the vertical distance between the symbol pattern of a playing card and its adjacent lateral edge<M< the vertical distance between the symbol pattern of a playing card and its adjacent lateral edge+5 mm. Take the commonly used playing cards (Bridge Size 8.8 cm long and 5.7 cm wide) as an example, 6 mm<M<12 mm. The value range of the vertical distance H between the center of the camera lens and the playing cards in the delivery channel is: 10 mm<H<15 mm.

In this manner, not only it is possible to avoid unnecessary scratching and obstruction between the playing cards and the side wall of the delivery channel, but also it can be ensured that the camera can still take a panoramic view of the position of the symbol on the playing cards when the playing cards are inclined in the delivery channel.

In addition, in order to avoid or reduce the influence of uncertain factors such as the advancing speed of the playing cards in the delivery channel, it is preferable to arrange the detection sensor for detecting the position of the playing cards and the camera 4238 adjacent to each other, so that the camera is activated immediately to take a panoramic view of the position of the symbol on the playing cards after the detection sensor detects that the playing cards are in place. In other embodiments, it may also be preferable to provide two cameras in the delivery channel. The two cameras are respectively close to the left and right side walls of the delivery channel. Multiple cameras are used for capturing and recognition to improve the accuracy and recognition efficiency of identification of the front or back side of the playing card.

It should be noted that the width of the above-mentioned delivery channel refers to the effective width of playing cards that can be delivered in the delivery channel, and the left or right side wall of the above-mentioned delivery channel refers to the theoretical left or right wall with the effective width. In an implementable embodiment, the left side wall or the right side wall of the delivery channel may be a visible structure formed by a position-limiting component, a position-limiting structure, a casing wall surface, etc., or a non-visible structure that actually exists and, for example, can limit the range that can be reached by the playing card in a specific range in the delivery channel by means of controlling the delivery method, speed, and direction of the delivery wheel/roller. The left and right boundaries of the specific range are regarded as the left side wall or the right side wall of the above-mentioned delivery channel.

As shown in FIG. 19, in this embodiment, a first sensor 4235, a second sensor 4236, and a third sensor 4237 are sequentially disposed on the delivery top wall 4218 or the delivery bottom wall 4204 of the delivery channel along the advancing direction of the playing cards. The first sensor 4235 and the third sensor 4237 operate together to detect the length and distance covered by the playing cards simultaneously in the delivery channel to determine whether there are multiple playing cards overlapping each other. If the first sensor 4235 and the third sensor 4237 are blocked simultaneously (the playing cards are detected), it is determined that two partially overlapping playing cards enter the delivery channel, and the card dealing electric motor 4220 reverses to reject the playing cards to the storage box 41 and the playing cards are fed in and distributed again.

In the case that playing cards are delivered forward along the widthwise side in the card dealing device (that is, the width of the delivery channel is similar to the width of the playing cards), the distance between the first sensor 4235 and the third sensor 4237 is 2 mm-3 mm longer than the length of the playing cards.

In the case that the playing cards are delivered forward along the lengthwise side in the card dealing device (that is, the width of the delivery channel is similar to the length of the playing cards), the distance between the first sensor 4235 and the third sensor 4237 is 2 mm-3 mm longer than the width of the playing cards.

The second sensor 4236 is arranged between the first sensor 4235 and the third sensor 4237, and when the sensor is blocked (a playing card is detected), the card flipping electric motor 4230 is activated as required to flip the cards. The second sensor 4236 can further cooperate with the first sensor 4235 and the third sensor 4237 to assist in determining whether there are multiple playing cards that are partially overlapped.

In this way, a single piece of playing card separated by the card separating mechanism is captured by the camera after passing through the first sensor for identifying its front side or back side. When the playing card continues to move forward along the channel to the position of the second sensor, according to the identification result, the card flipping mechanism is controlled to flip the playing cards or not to flip the playing cards. If the first sensor is blocked and the third sensor is blocked simultaneously (that is, the playing cards are continuously detected), it means that two playing cards are partially overlapped and they enter the delivery channel. The card dealing electric motor is reversed to return the playing cards that enter the card passing channel back to the storage box for the playing cards to be separated into single pieces again, thereby ensuring the accuracy of the number of playing cards that are dealt.

The image identification method is used to identify the front and back sides of the playing card. Due to the irregularity of the pattern on the back of the playing card, it is very likely to cause incorrect identification. Therefore, it is preferable to use the learning mode to identify the front and back sides of the playing cards. In this way, the learning mode can be used to perform identification learning on the playing cards that are fed into the poker machine, so as to improve the identification efficiency and accuracy of the poker machine on the playing cards.

The learning mode may be automatic coding or convolutional neural network. The neural network does not need a mathematical model. In fact, it takes a feature pattern for comparison. If there is a match, the comparison of other positions or the entire image is activated. This model requires a lot of memory and a powerful CPU. Therefore, it is preferable to adopt the learning mode of deep automatic coding, which is to first develop a mathematical model (encoder), sample the input pattern in multiple layers, extract abstract feature information, use the encoder to generate the feature code, and use a certain number of samples to correct the feature code.

In this embodiment, the method of using learning mode to identify the front or back side of the playing cards is to sample the pattern on the back side or the symbol pattern on the front side of the multiple playing cards to generate a feature code, save the feature code, and then use this feature code to match the pattern to be compared, thereby identifying the front and back sides of the playing cards.

The preferred implementation is that the poker machine is configured with a learning mode and a card playing mode. In the learning mode, multiple playing cards which are consistently arranged with front side down or back side down are fed in (for example, a set of new playing cards with consistent front side and back side). The poker machine samples the pattern on the back side or the symbol pattern on the front side of the multiple playing cards to generate a feature code, and saves the feature code. In the card playing mode, the poker machine obtains the pattern on the back side or the symbol pattern on the front side of the multiple playing cards, and uses this feature code to match the patterns in comparison to identify the front and back sides of the playing cards. The card flipping mechanism is controlled to flip the playing cards or not to flip the playing cards according to the identification result.

Figure 11:
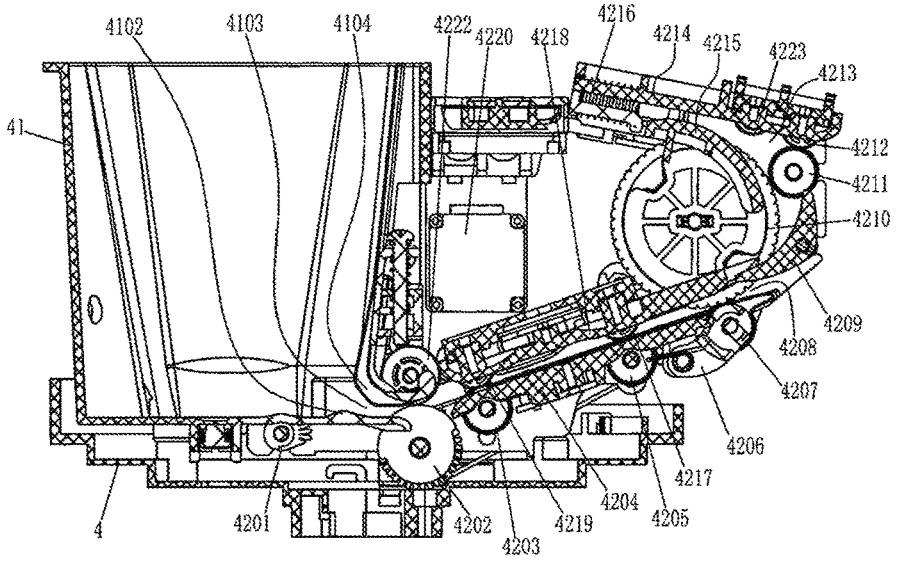
FIG. 11 is a second cross-sectional view of the dealer of the disclosure (direct dealing status).
Figure 12:
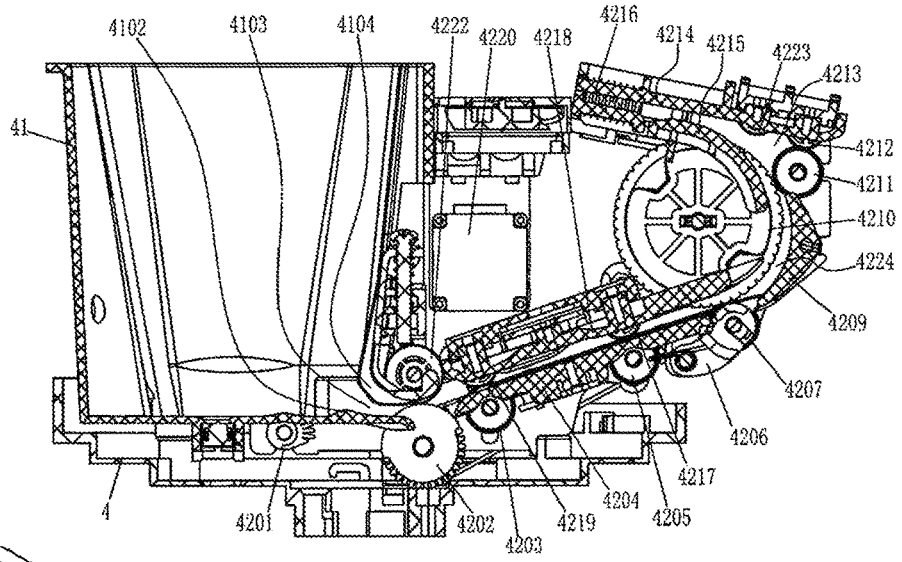
FIG. 12 is a third cross-sectional view of the dealer of the disclosure (dealing status after card flipping).
Figure 15:
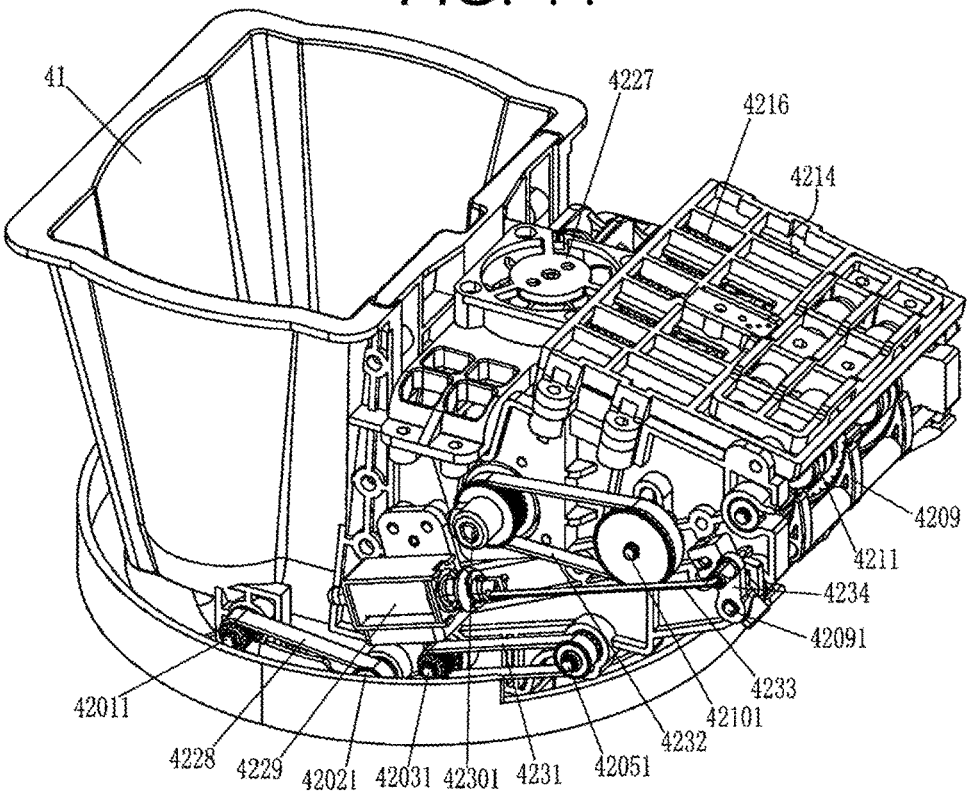
FIG. 15 is a second perspective view of the dealer of the disclosure.

As shown in FIG. 9 to FIG. 12, the card flipping mechanism includes the first card discharging press wheel 4207, the card flipping wheel 4210, the card flipping press wheel 4211 and the second card flipping press wheel 4212. The card flipping wheel 4210 is the driving wheel and is driven to rotate by the card flipping electric motor 4230 (as shown in FIG. 15, the card flipping electric motor shaft 42301 and the card flipping axle 42101 are drivenly connected through the card flipping transmission belt 4232). The first card discharging press wheel 4207, the card flipping press wheel 4211 and the second card flipping press wheel 4212 are all driven wheels. The first card discharging press wheel 4207 and the card flipping press wheel 4211 are in rolling contact with the card flipping wheel 4210 respectively. The second card flipping press wheel 4212 and the card flipping press wheel 4211 are in rolling contact. The first card discharging channel 4208 is formed between the card flipping wheel 4210 and the first card discharging press wheel 4207. The card flipping channel 4224 is formed between the card flipping wheel 4210 and the card flipping press wheel 4211. The second card discharging channel 4213 is formed between the card flipping press wheel 4211 and the second card flipping press wheel 4212. The card flipping wheel 4210 is arranged at the inner side of the card flipping channel 4224 and located between the first card discharging channel 4208 and the second card discharging channel 4213. The card flipping channel 4224 is extended along the partial arc-shaped circumference of the card flipping wheel 4210 from one side of the card flipping wheel 4210 close to the first card discharging channel 4208 to the other side of the card flipping wheel 4210 away from the first card discharging channel 4208. The card flipping component 4209 configured to open or close the card flipping channel 4224 or the first card discharging channel 4208 is configured at one end outside the card flipping channel 4224 close to the first card discharging channel 4208. The card pushing component 4216 is provided at one end of the card flipping channel 4224 away from the first card discharging channel 4208. The second card discharging channel 4213 is disposed at a position outside the card flipping channel 4224 and opposite to the card pushing component 4216. The card flipping component 4209 is driven to swing by the card flipping drive mechanism, so to open or close the card flipping channel 4224 or the first card discharging channel 4208. As shown in FIG. 11, when the card flipping component 4209 closes the card flipping channel 4224 or opens the outlet of the first card discharging channel 4208, the card feeding channel 4103, the delivery channel and the first card discharging channel 4208 are connected in sequence. The playing card is sent from the first card discharging channel 4208 to the card receiving position of the card receptor 2. As shown in FIG. 12, when the card flipping component 4209 opens the card flipping channel 4224 and the closes the outlet of the first card discharging channel 4208, the card feeding channel 4103, the delivery channel, the first card discharging channel 4208, the card flipping channel 4224 and the second card discharging channel 4213 are connected in sequence. The playing cards are blocked by the card flipping component 4209 and turned to enter the card flipping channel 4224 after being discharged from the first card discharging channel 4208, and sent to the terminal end of the card flipping channel 4224 by the card flipping wheel 4210 and the card flipping press wheel 4211. The front end of the playing card abuts against the card pushing component 4216. The rear end of the playing card is restored to the flat state after passing through the card flipping press wheel 4211. Being pushed by the card pushing component 4216, the rear end of the playing card enters the second card discharging channel 4213 first, and sent to the card receiving position of the card receptor 2 by the card flipping press wheel 4211 and the second card flipping press wheel 4212. In this way, the playing card that passes through the card flipping channel is rotated by 180° in front-back direction to turn the playing card over.

It should be noted that in other embodiments of the disclosure, the first card discharging channel 4208 and the second card discharging channel 4213 may not be directly connected to the outlet of the card receiving position of the card receptor 2. That is, one or more channels (or delivery wheel/conveying roller) that continuously deliver the playing cards may be arranged after the first card discharging channel 4208 and/or the second card discharging channel 4213 to send the playing cards to the card receiving position of the card receptor 2.

The card flipping wheel 4210, the first card discharging press wheel 4207, the card flipping press wheel 4211 and the second card flipping press wheel 4212 each can be a roller part, or can be composed of multiple wheel-shaped parts mounted on the same axle. In this embodiment, the card flipping wheel 4210, the first card discharging press wheel 4207, the card flipping press wheel 4211 and the second card flipping press wheel 4212 all include multiple wheels mounted on their respective axles. The card flipping component 4209 further includes multiple components disposed on the same shaft. The card flipping component 4209 and the card flipping wheel 4210 are arranged in misalignment. In this way, the structure is simple, and the configuration and fitting of components are convenient. Rubber rings may be provided on the card flipping wheel 4210, the first card discharging press wheel 4207, the card flipping press wheel 4211 and/or the second card flipping press wheel 4212 to increase the friction between them and the playing cards.

Figure 24:
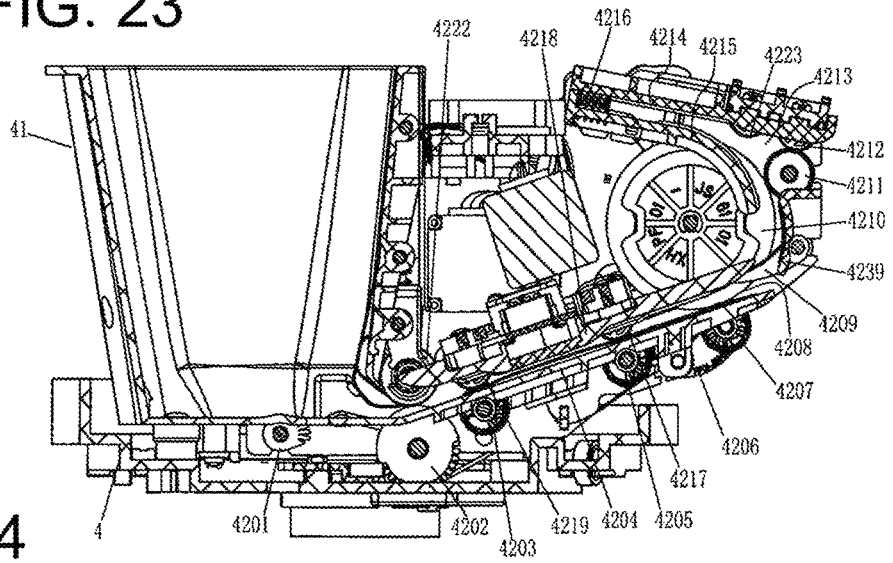
FIG. 24 is a first cross-sectional view of another embodiment of the dealer of the disclosure (direct dealing status).
Figure 25:
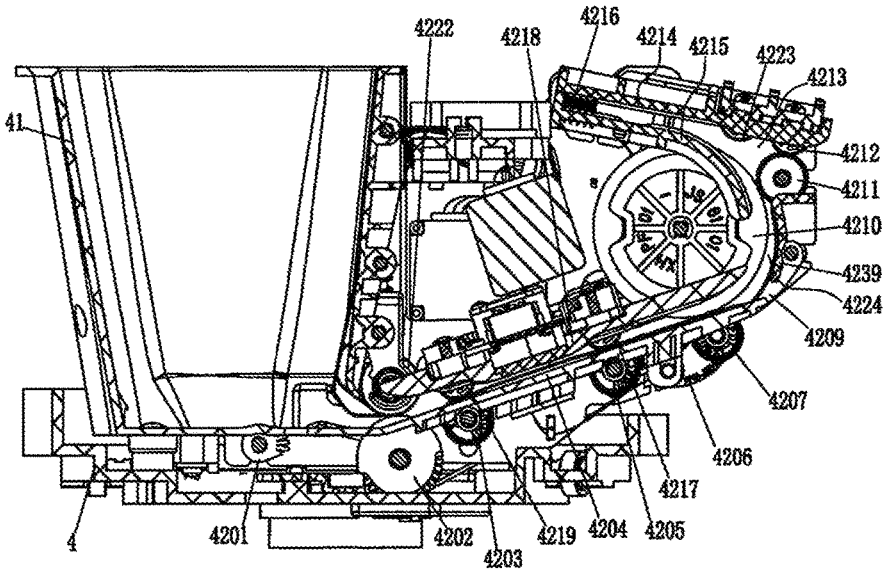
FIG. 25 is a second cross-sectional view of another embodiment of the dealer of the disclosure (dealing status after flipping cards).
Figure 26:
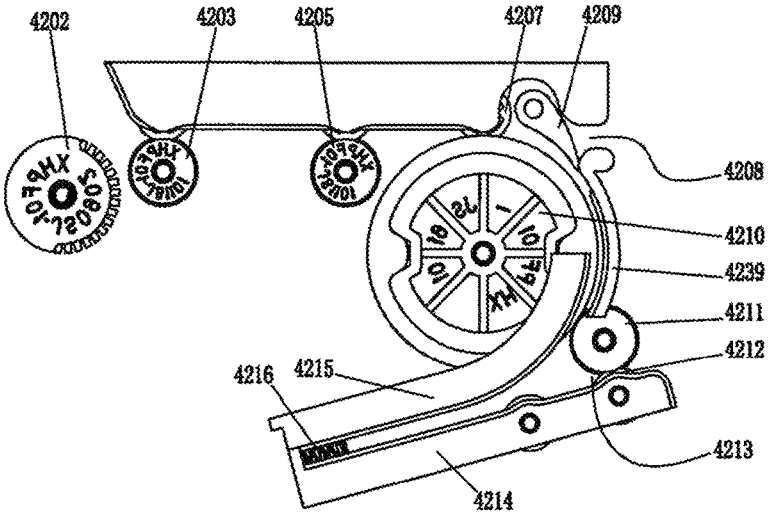
FIG. 26 is a schematic view of yet another embodiment of the dealer of the disclosure (card dealing state after flipping cards).

In this embodiment, as shown in FIG. 11 to FIG. 14, the card flipping channel 4224 includes the card flipping channel inner side wall 4215, and the swing center (card flipping axle 42091) of the card flipping component 4209 is located in the middle, and therefore there are two swing end portions formed at both sides of the swing center. The inner side of the card flipping component 4209 is in an arc shape corresponding to the outer periphery of the card flipping wheel 4210. In this way, the card flipping component 4209 not only can better serve the blocking and turning function, but also the card flipping component 4209 can serve as the card flipping channel outer side wall, and there is no need to set an additional card flipping channel outer side wall. In other embodiments, as shown in FIG. 24, FIG. 25 and FIG. 26, the swing center (card flipping axle 42091) of the card flipping component 4209 is located at one end. It is necessary to set the card flipping channel outer side wall 4239 to ensure that the playing card passes through smoothly in the card flipping channel 4224.

In this embodiment, the card flipping channel 4224 and the second card discharging channel 4213 are arranged above the first card discharging channel 4208 (that is, the card flipping wheel 4210, the card flipping press wheel 4211 and the second card flipping press wheel 4212 are located above the first card discharging press wheel 4207). In this way, the height of the dealer and even the poker machine is more reasonable, the model is thinner and the number of cards that can be stored is more. Of course, if space permits, the card flipping channel 4224 and the second card discharging channel 4213 may be arranged under the first card discharging channel 4208 (that is, the card flipping wheel 4210, the card flipping press wheel 4211 and the second card flipping press wheel 4212 are located under the first card discharging press wheel 4207), as shown in FIG. 26.

In order to prevent the playing cards from getting stuck at the position close to the side wall in the card flipping channel 4224, in order to ensure that the playing cards can enter the second card discharging channel 4213 arranged between the card flipping press wheel 4211 and the second card flipping press wheel 4212, a transition wheel 4223 is provided at one side of the second card discharging roller-pressing frame 4214 provided with the second card flipping press wheel 4212 close to the card flipping wheel 4210, so as to guide the playing card to the position between the card flipping press wheel 4211 and the second card flipping press wheel 4212.

In order to ensure the delivery pressure and avoid slipping, it is preferable to give the first card discharging press wheel 4207 and/or the card flipping press wheel 4211 the tendency to press the card flipping wheel 4210 hard through respective enabling mechanisms, and to give the second card flipping press wheel 4212 the tendency to press the card flipping press wheel 4211 hard through respective enabling mechanisms. These respective enabling mechanisms can be elastic components such as springs, shrapnels, elastic rings, or elastic shafts, or they can be elastic enabling mechanisms composed of multiple components. In the embodiment, the first card discharging press wheel 4207 is rotatably mounted on the first card discharging roller-pressing frame 4206. The first card discharging roller-pressing frame 4206 is hinged with the delivery bottom wall 4204 of the delivery channel, and is provided with the torsion spring at the hinged shaft, so as to facilitate the first card discharging press wheel 4207 to press the card flipping wheel 4210 hard. The card flipping press wheel 4211 is provided with an elastic rubber ring so as to press against the card flipping wheel 4210 hard. The second card flipping press wheel 4212 is disposed on the second card discharging roller-pressing frame 4214 through an elastic shaft so as to press the card flipping press wheel 4211 hard. Such configuration is convenient, and the structure is simple and reliable.

The card flipping driving mechanism that drives the card flipping component 4209 to open or close the first card discharging channel 4208 (open the card flipping channel 4224) can be realized by an electric motor through a deceleration mechanism or a transmission mechanism. In this embodiment, as shown in FIG. 15, the electromagnet 4229 is used for driving. One end of the card flipping axle 42091 of the card flipping component 4209 fixes the crank 4234. The swing end of the crank 4234 is connected to the movable end of the electromagnet 4229 through the connecting rod 4233. When the card flipping component 4209 is required to operate, the electromagnet 4229 pulls the card flipping component 4209 to swing through the connecting rod 4233 and the crank 4234. Because the card flipping action is performed based on the result of the camera identifying the front and back sides of the playing card, which is selective and intermittent, the electromagnet structure in this embodiment is more reasonable and the manufacturing cost is low.

The card pushing component 4216 can be an elastic component such as a spring, an elastic piece, an elastic band, or the like, or an elastic enabling mechanism composed of multiple components. In this embodiment, the card pushing component 4216 is a plurality of springs arranged at the terminal end of the channel. This structure is simple and easy to dispose.

In another alternative implementation of the card flipping mechanism, the card flipping channel 4224 is directly connected to the storage box 41, and the second card discharging channel 4213, the second card flipping press wheel 4212 and the card pushing component 4216 are no longer provided. The cards that are flipped over are returned directly to the storage box and the cards are fed in and dealt again. That is, the card flipping mechanism includes the first card discharging press wheel, the card flipping wheel and the card flipping press wheel. The card flipping wheel is a driving wheel and is driven to rotate by the card flipping electric motor. The first card discharging press wheel and the card flipping press wheel are both driven wheels. The first card discharging press wheel and the card flipping press wheel are in rolling contact with the card flipping wheel respectively. The first card discharging channel is formed between the card flipping wheel and the first card discharging press wheel. A card flipping channel is formed between the card flipping wheel and the card flipping press wheel. The card flipping wheel is arranged inside the card flipping channel. The card flipping channel is extended along the partial arc-shaped circumference of the card flipping wheel from one side of the card flipping wheel close to the first card discharging channel to the other side of the card flipping wheel away from the first card discharging channel. The terminal end of the card flipping channel is connected to the space in the storage box. The card flipping component that is configured to open or close the card flipping channel or the first card discharging channel is arranged at one end outside the card flipping channel close to the first card discharging channel. When the card flipping component closes the card flipping channel or opens the outlet of the first card discharging channel. The card feeding channel, the delivery channel and the first card discharging channel are connected in sequence. The playing cards are sent to the card receiving position of the card receptor through the first card discharging channel. When the card flipping component opens the card flipping channel and closes the outlet of the first card discharging channel, the card feeding channel, the delivery channel, the first card discharging channel, and the card flipping channel are connected in sequence. After the playing card is discharged from the first card discharging channel, the playing card is blocked by the card flipping component and turned to enter the card flipping channel. Then, the playing card is sent to the terminal end of the card flipping channel by the card flipping wheel and the card flipping press wheel and enter the storage box (a number of delivery wheels and press wheels thereof may be provided between the storage box and the card flipping wheel to deliver the playing card). In this way, the playing card that passes through the card flipping channel is flipped over in front-back direction so as to turn the playing card over. The rest of the structure is the same as that described above. The structural solution can be adopted to design the storage box with a shallow depth, a poker machine with a low height. However, in such design, the card dealing efficiency is relatively low, and the manufacturing cost is high.

The aforementioned poker machine includes a card receptor 2 and a dealer. The dealer is disposed in the center of the card receptor 2 and is driven to rotate relative to the card receptor 2 by a rotary drive mechanism. A plurality of card receiving positions are set around the dealer on the card receptor 2. The dealer includes a storage box 41 and a card dealing device 42. The storage box 41 and the card dealing device 42 are respectively located on the left and right sides of the card dealing base 4, and one side of the bottom of the storage box 41 is connected to the card feeding channel of the card dealing device 42. The card dealing device 42 includes a card distributing mechanism for separating a stack of playing cards organized in the storage box into single pieces of playing cards and sending them to the delivery mechanism, a delivery mechanism for identifying the front and back sides of the playing card and delivering the playing card to the card flipping mechanism, as well as a card flipping mechanism for flipping the playing card as needed and sending the playing card to each card receiving position on the card receptor 2.

The playing card collating method of the poker machine as described above includes the following steps:

1) The playing cards organized into a stack are placed into the storage box.

2) The card distributing mechanism separates a stack of playing cards organized in the storage box into single pieces of playing cards and sends them to the delivery mechanism.

3) The delivery mechanism identifies the front and back sides of the playing card and delivers the playing card to the card flipping mechanism.

4) The card flipping mechanism flips the playing card as needed and sends the playing card to each card receiving position on the card receptor.

Embodiment 2

Figure 27:
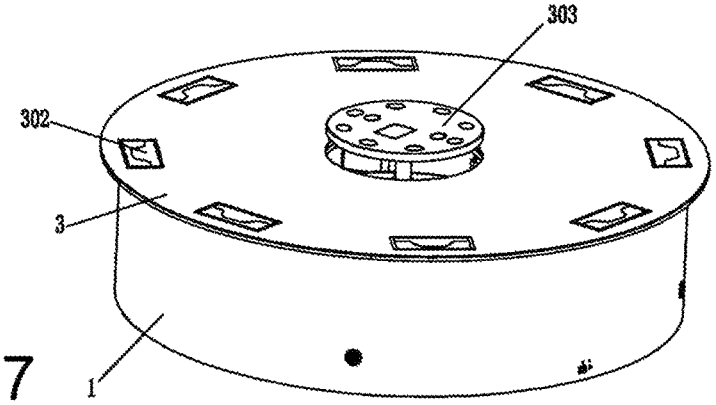
FIG. 27 is a schematic structural view of another embodiment of the poker machine of the disclosure.
Figure 28:
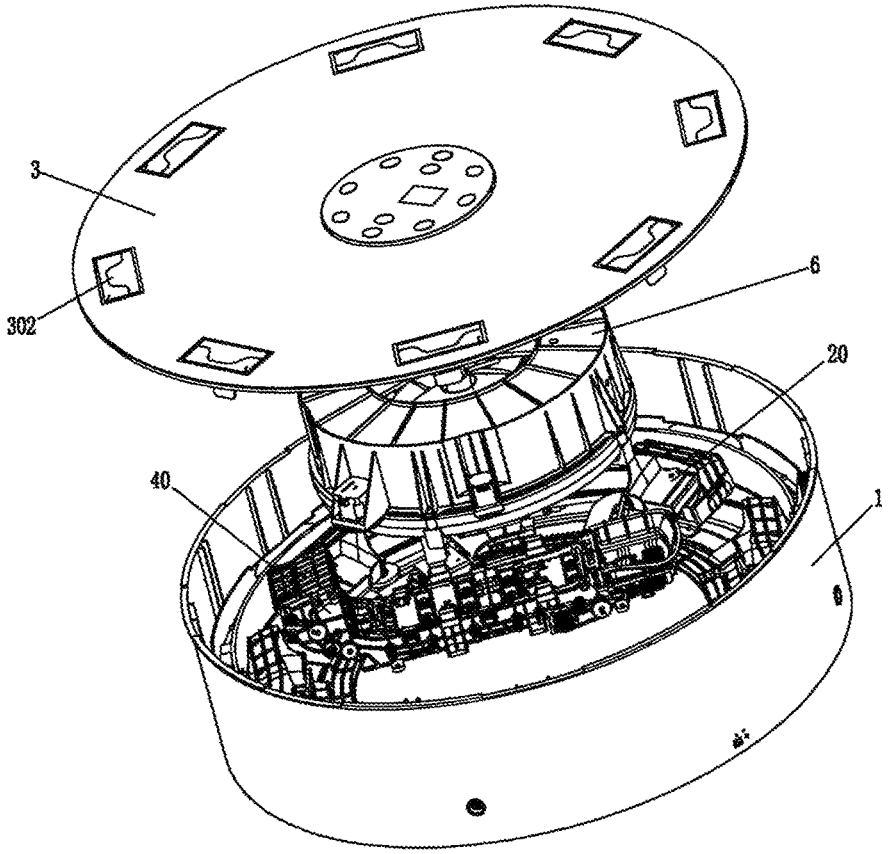
FIG. 28 is an exploded view of another embodiment of the poker machine of the disclosure.
Figure 29:
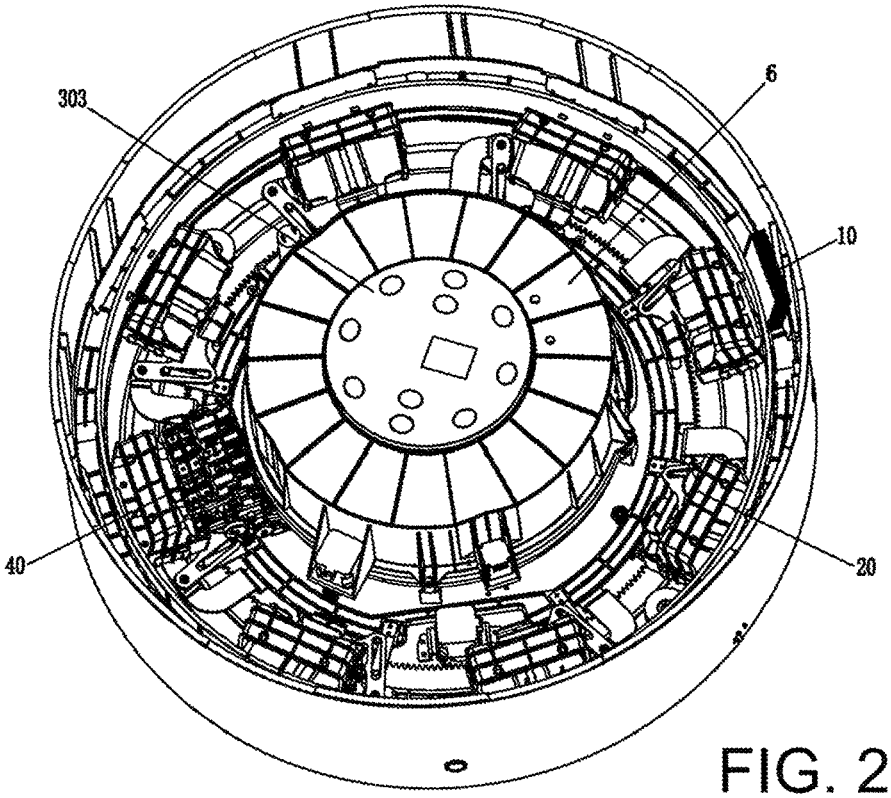
FIG. 29 is a perspective view of another embodiment of the poker machine of the disclosure (with the panel removed).

A poker machine as shown in FIG. 27, FIG. 28 and FIG. 29 includes: a base 1, and a card collating device 6, a dealer 40 and a card receiving device 20 disposed on or inside the base. The card collating device 6 is disposed above the dealer 40. The dealer includes a storage box 41 and a card dealing device 42, and the outlet of the card collating device 6 is connected to the storage box 41. The card receiving device 20 includes a plurality of card receiving positions or card receiving boxes 210 arranged around the dealer 40. These card receiving positions or the card receiving boxes 210 are driven by the rotary drive mechanism to rotate relative to the dealer 40.

In this embodiment, a method that is similar to the method of a mahjong machine for feeding card in the center is provided. A panel 3 is provided at the top of the base 1. The card feeding device includes the following: a control disk 303 is set in the center of the panel 3, and the control disk 303 is driven to move up and down by the central lifting mechanism. When the control disk 303 is raised, a card feeding port is formed underneath the control disk 303 for feeding the playing card. When the control disk 303 is lowered, the card feeding port is covered, and the card collating device 6 is disposed under the control disk 303.

This poker machine can be placed on the desktop as an independent machine for players to use. In this scenario, there can be multiple openings on the side wall of the base for players to reach in and take the playing card. The corresponding card pushing mechanism can be used to reject the playing card of all parties to the multiple card taking positions outside the side wall of the base. Of course, multiple openings can also be provided on the panel 3 at the top for players to take the playing cards. Most of the time, this poker machine is embedded in the center hole of the card table, and only the panel 3 and the control disk 303 are exposed and aligned with the desktop, so that the machine does not interfere with the players to play the game. Besides, the machine can be easily manufactured, disposed and maintained. When the machine works, a lifting drive mechanism needs to be provided on the card receiving device 20 to drive the distributed playing cards of all parties to rise to the desktop for the players to take the playing cards.

In this embodiment, the base 1 includes a circular bottom plate and a barrel-shaped side wall, and a power supply and its power switch are arranged on the base. The panel 3 is provided with a plurality of card serving ports 302 around the control disk 303, and a cover plate is arranged on the card serving ports 302 (when the playing cards are served, the cover plate can be driven to erect and open, or can open spontaneously through the corresponding drive mechanism). The card receiving device 20 is provided below the card serving port 302. It should be noted that the base of the disclosure is not limited to a cylindrical shape, and may also be a square column shape, a polygonal column shape, a quincunx column shape, a tapered shape, and various other shapes.

Figure 32:
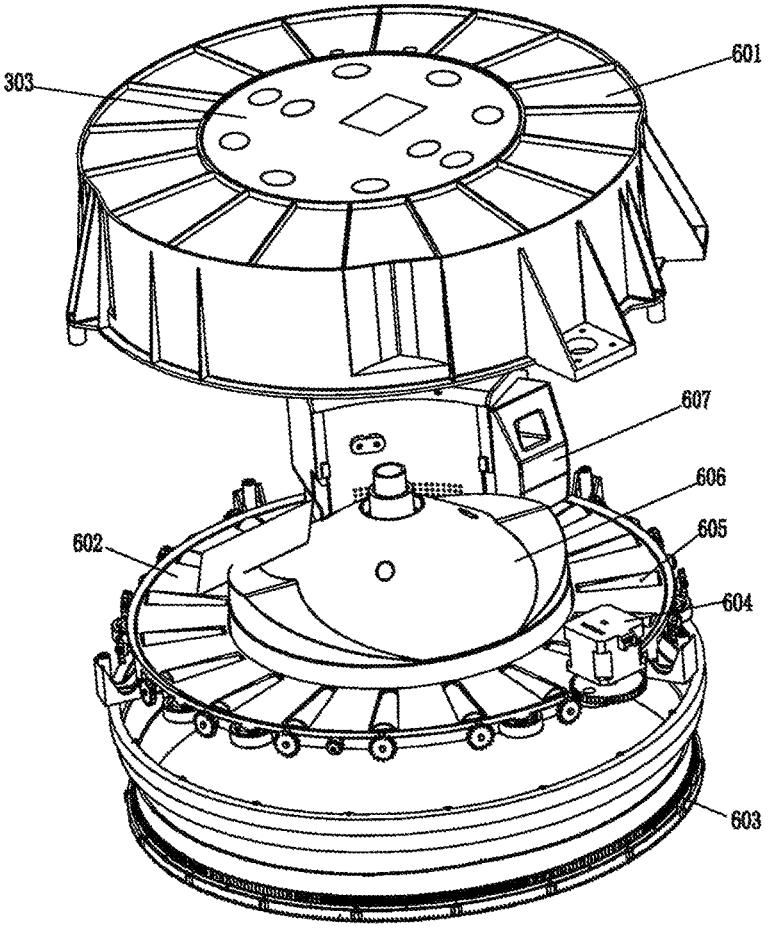
FIG. 32 is an exploded view of a card collating device in another embodiment of the poker machine of the disclosure.
Figure 33:
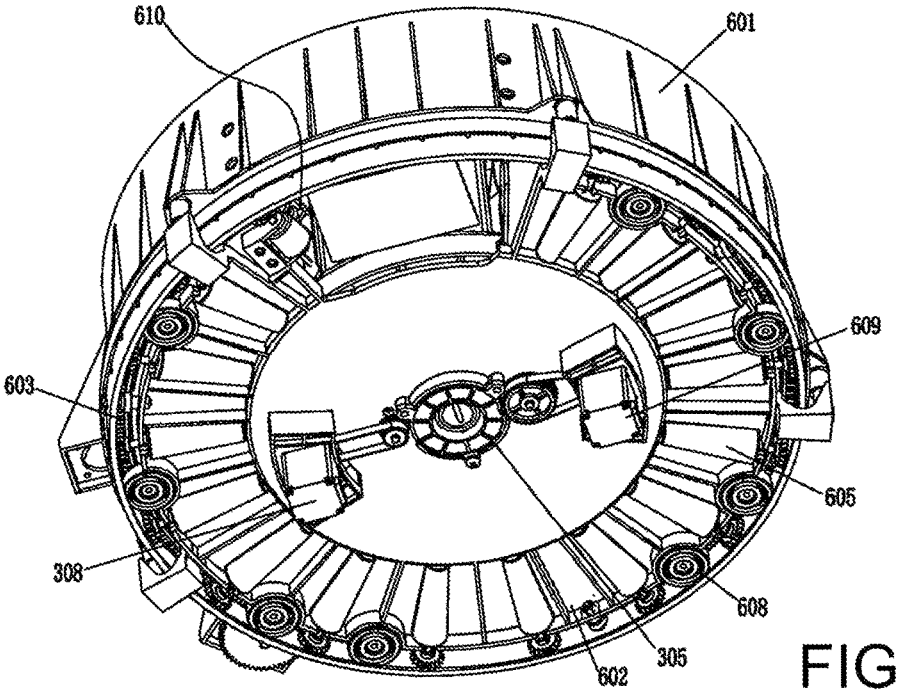
FIG. 33 is a schematic view of the structure of a card collating device in yet another embodiment of the poker machine of the disclosure.
Figure 34:
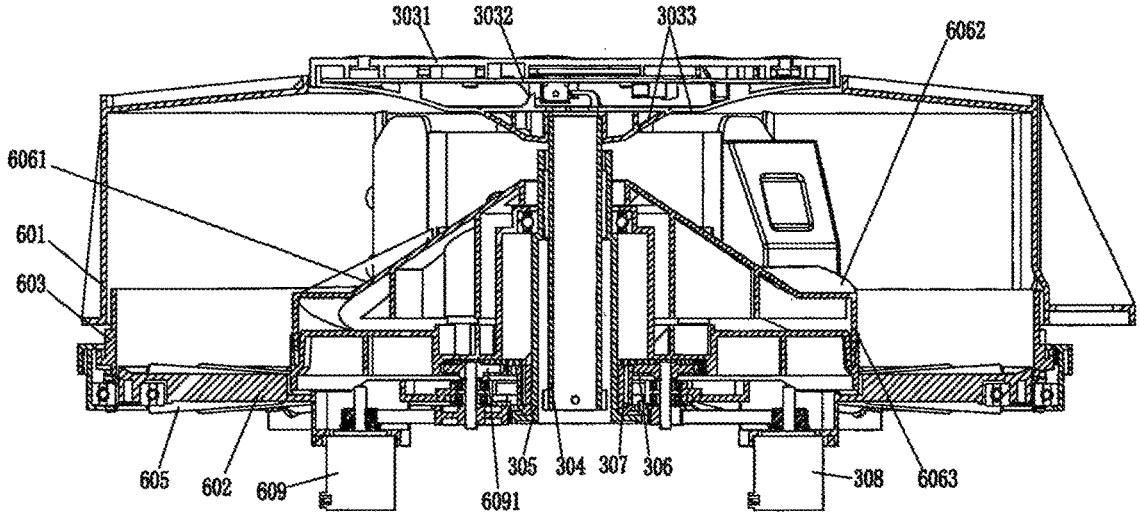
FIG. 34 is a cross-sectional view of a card collating device in still another embodiment of the poker machine of the disclosure.

As shown in FIG. 32, FIG. 33 and FIG. 34, the card collating device 6 includes the card collating base 602, the card collating channel outer side wall 603 and the center rotating disc 606. The card collating base 602 is fixed directly or indirectly on the base 1, and the center of the card collating base 602 is provided with the rotating disc 606. The center rotating disc 606 is driven to rotate by the rotating disc electric motor 609 arranged on the card collating base 602. The card collating channel outer side wall 603 is set around the card collating base 602. The arc-shaped card collating channel for organizing the playing cards is formed between the center rotating disc 606 and the card collating channel outer side wall 603. The bottom of the arc-shaped card collating channel is provided with multiple conveying rollers 605 for delivering the playing card. One end of the arc-shaped card collating channel is provided with the card discharging baffle 607. A card collating channel outlet 610 is formed between the card discharging baffle 607 and the bottom of the arc-shaped card collating channel for the playing card to be sent along its lengthwise direction. The storage box 41 of the dealer 40 is located under the card collating channel outlet 610 to receive the sent playing card. The width of the arc-shaped card collating channel is less than the length of the playing card and greater than the width of the playing card. The distance between two adjacent conveying rollers 605 is less than the length of the playing card, and the width of the card collating channel outlet 610 is similar to the width of the playing card. In this way, the disordered playing card inserted from the card feeding port is rotated through the center rotating disc 606 and pushed to the arc-shaped card collating channel. The playing cards having the lengthwise direction that is substantially consistent with the conveying direction of the conveying rollers 605 in the arc-shaped card collating channel are conveyed from the card collating channel outlet 610 by the conveying rollers 605. The inner side and outer side of the playing cards having the lengthwise direction that is substantially inconsistent with the conveying direction of the conveying rollers 605 in the arc-shaped card collating channel are rotated by the center rotating disc 606 and conveying rollers 605 until the lengthwise direction of the playing cards is substantially consistent with the conveying direction of the conveying rollers 605 in the arc-shaped card collating channel. As such, the disordered playing cards can be organized in the widthwise direction and sent for collation. Preferably, the rotating direction of the center rotating disc 606 is opposite to the direction along which the conveying rollers 605 conveys the playing card, so as to facilitate the playing cards that face different sides to rotate, so as to collate the playing cards to face the same direction, thereby increasing the card collating efficiency.

Figure 35:
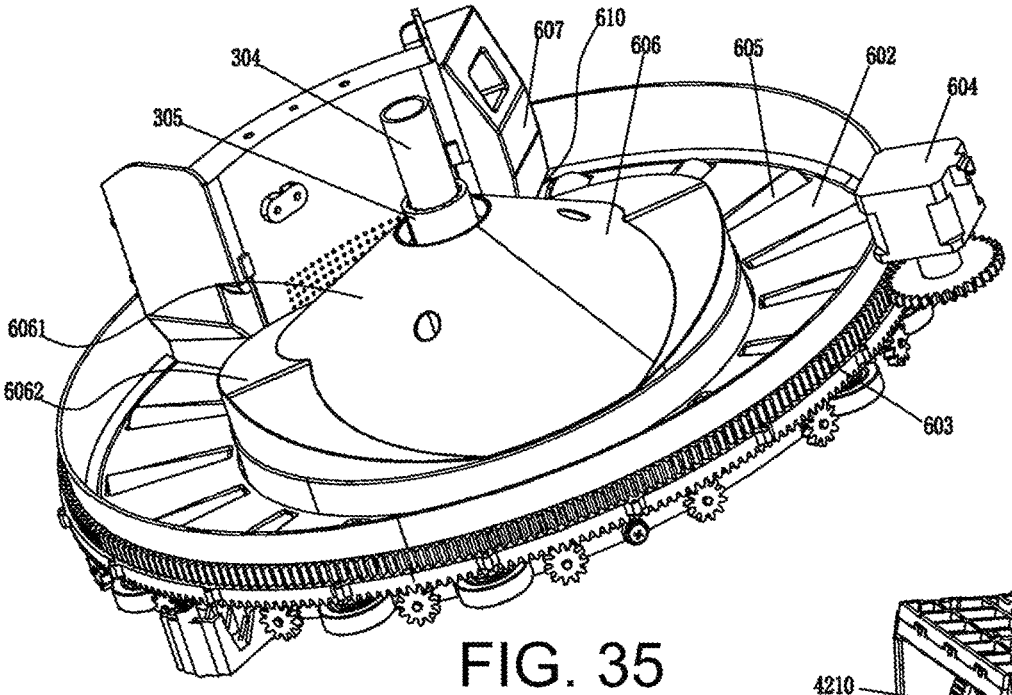
FIG. 35 is a schematic view of the internal structure of a card collating device in another embodiment of the poker machine of the disclosure.
Figure 36:
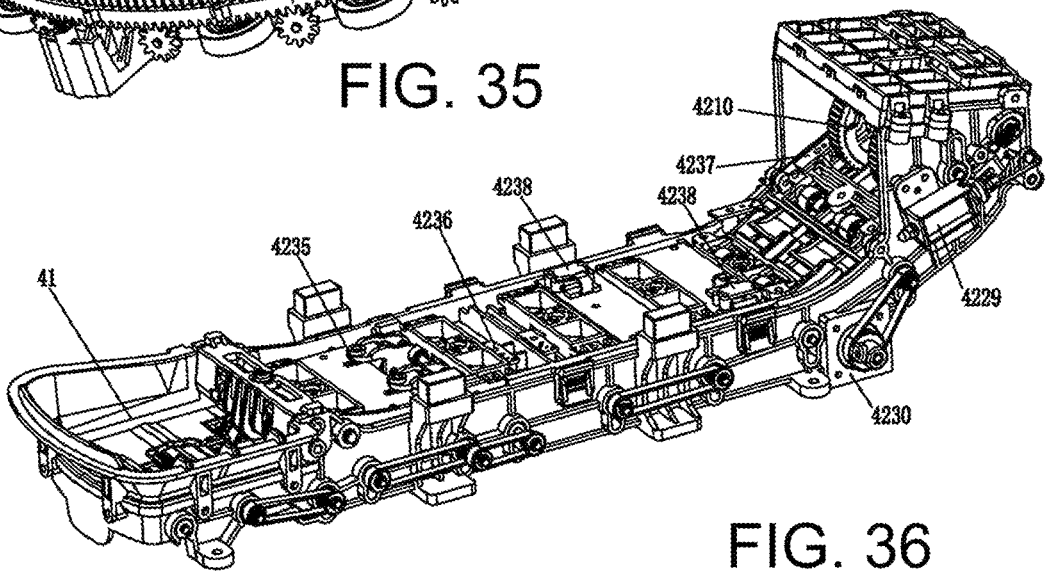
FIG. 36 is a first structural schematic view of the dealer in another embodiment of the poker machine of the disclosure.
Figure 37:
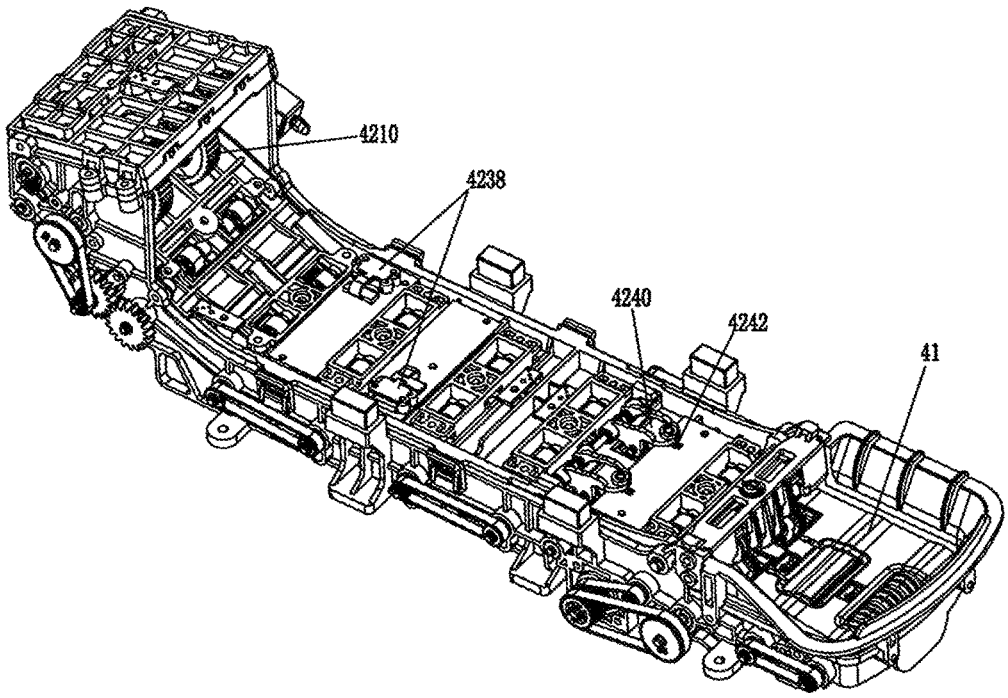
FIG. 37 is a second structural schematic view of the dealer in still another embodiment of the poker machine of the disclosure.
Figure 38:
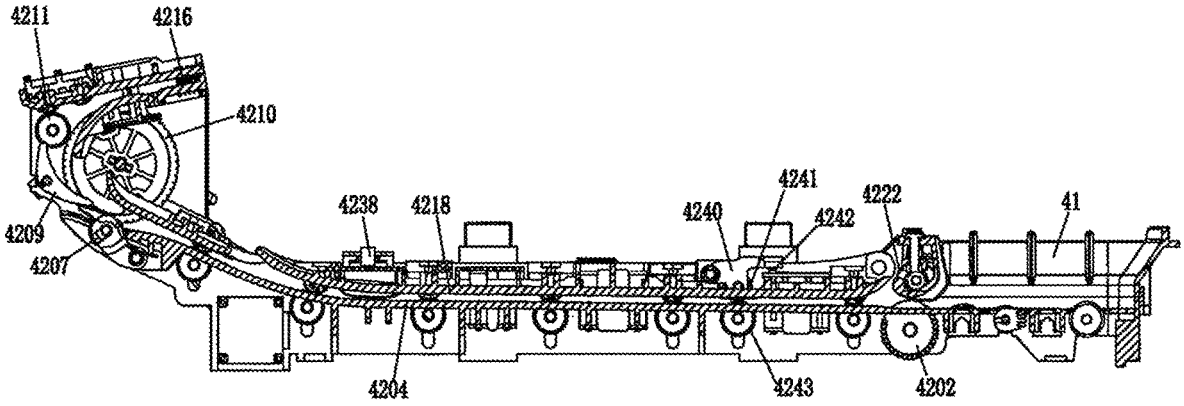
FIG. 38 is a cross-sectional view of the dealer in yet another embodiment of the poker machine of the disclosure.

As shown in FIG. 35, the top of the center rotating disc 606 is the rotating disk upper tapered surface 6061. The lower edge of the rotating disk upper tapered surface 6061 is provided with a number of rotating disc card pushing slopes 6062 that are arranged around the circumference of the center rotating disc 606 and protrude upward. The rotating disk side wall 6063 is formed at the lower part of the center rotating disc 606 at a position close to the bottom of the card collating channel. In this way, the rotating disk upper tapered surface 6061 helps the playing card to move toward the edge around the center rotating disc 606 and fall into the card collating channel. The rotating disc card pushing slope 6062 can move the playing card to rotate while preventing the playing card from being jammed or floated. The rotating disk side wall 6063 is arranged in a vertical manner so as to limit the position of the playing card at the bottom of the card collating channel and ensure the delivery direction.

In order to further improve the card collating efficiency and the card delivery efficiency of the card collating channel, preferably, the plurality of conveying rollers 605 is distributed along the radial direction of the circular center rotating disc 606, and the conveying rollers 605 adopt tapered rollers with a small inner radius and a large outer radius. In this way, by forming different delivery areas and delivery speeds at the inside and outside of the card collating channel, it is possible to deliver the playing card rapidly in the circular arc-shaped card collating channel, thereby preventing the playing card from being jammed or floated.

In order to further improve the card collating efficiency, preferably, the card collating channel outer side wall 603 is supported and erected on the card collating base 602 by a plurality of outer support rollers 608 and driven to rotate by an outer electric motor 604. In this way, the card collating channel outer side wall 603 can also be actively rotated. By reasonably controlling the rotation direction and/or speed of the center rotating disc 606 and the card collating channel outer side wall 603, the card collating efficiency can be improved and the playing card can be prevented from jamming and floating.

In a preferred embodiment, the card collating channel outer side wall 603 is integrally formed or fixed with an outer gear and a bottom gear. The outer electric motor 604 fixed on the card collating base 602 or the base 1 is driven by the engagement between the gear and the outer gear, thus driving the channel outer side wall 603 to rotate. The bottom gear meshes with the outer gear of the conveying rollers 605 to drive the conveying rollers 605 to rotate, such structure is simple and reasonable, convenient for manufacturing and assembling, and has low cost.

In order to further improve the efficiency and stability of collating playing cards, a card discharging mechanism is arranged in the card collating channel outlet 610. For the specific structure of the card discharging mechanism, please refer to patent documents such as WO2018196759A1, CN105854275, etc., which generally include a card discharging active roller and the press rollers thereof driven by a card discharging electric motor.

In this embodiment, an upper casing 601 is fixed above the card collating base 602 for covering the center rotating disc 606 and the card collating channel. In this way, the card collating channel forms a relative closed space to prevent the inserted playing card from entering other mechanisms of the core and causing a mess while enhancing the card collating efficiency. Of course, in other embodiments, a casing for shielding the card collating base 602 and the transmission component thereon can be arranged on the lateral surface or bottom of the card collating base 602. Correspondingly, the card discharging mechanism can be arranged on the card discharging baffle 607, or arranged on the card collating base 502 or the upper casing 601.

In this embodiment, the other end of the arc-shaped card collating channel is closed, and the storage box is located between the closed end and the outlet end of the arc-shaped card collating channel. In other embodiments, in order to further improve the card collating device efficiency, a card collating channel outlet is set at both ends of the arc-shaped card collating channel, and the storage box is located in the middle of the two outlets. The playing cards that come out from the two outlets directly enter the storage box. Generally speaking, the rotation speed and direction of the center rotating disc, conveying rollers and/or card collating channel outer side wall can be controlled to discharge the playing cards alternately from the two outlets. In this way, it is possible to prevent the long delivery distance for a part of playing cards at one outlet as well as the problem of card jamming at a blind spot. As such, playing cards can be discharged rapidly and card can be collated efficiently.

In this embodiment, buttons are provided on the control disk 303 to control power-on, card shuffling, and card serving. During the card game, the player can set playing rules on the control panel. The poker machine distributes cards to each player according to the set playing rules. When the cards are dealt, the playing card of each player is randomly distributed by the dealer, and the playing cards are distributed intermittently to the card receiving position or card receiving box of each party according to the number of cards set by the player. The description of the control disk 303 and its central lifting mechanism can be derived from the central lifting mechanism of the mahjong machine, such as the central lifting mechanism disclosed in patent documents such as CN206881093, CN206881095, CN205235367, etc.

In this embodiment, as shown in FIG. 34, the control disk 303 includes a control disk panel 3031, a control disk circuit board 3032, and a control disk base 3033. The control disk circuit board 3032 is fixed in the control disk base 3033, and the control disk panel 3031 covers the control disk circuit board 3032. The central lifting mechanism includes a lifting guide rod 304, a lifting base 305, a central lifting cam 307, and a central lifting electric motor 308. The control disk base 3033 is fixed on the upper end of the lifting guide rod 304. The lifting guide rod 304 is sleeved with a lifting base 305, the lifting base 305 is fixed on the card collating base 602, and the lower part of the lifting base 305 is sleeved with a central lifting cam 307. A groove is provided at both sides of the lifting base 305, the lower end of the lifting guide rod 304 is fixed with a support rod, and both ends of the support rod extend out of the groove of the lifting base 305 and can move up and down along the groove. The two protruding ends of the support rod abut against the cam curved surface on the central lifting cam 307. The central lifting cam 307 is driven to rotate by the central lifting electric motor 308, thereby driving the support rod and its lifting guide rod 304 to move up and down, thereby driving the control disk at the top of the lifting guide rod 304 to rise and fall.

In this embodiment, the outer side of the central lifting cam 307 is integrally formed or fixed with an outer gear, and is drivenly connected to the central lifting electric motor 308 fixed on the card collating base 602 through the lifting intermediate gear 306 and/or the transmission belt. In other embodiments, the central lifting cam 307 and the central lifting electric motor 308 may also be connected by other transmission methods, for example, a deceleration mechanism is provided between the two or a chain is used for transmission. In other embodiments, rollers or bearings can also be arranged on the two protruding ends of the support rod to abut against the cam curved surface on the central lifting cam 307.

In this embodiment, the center rotating disc 606 is sleeved outside the lifting base 305, and the upper end of the lifting base 305 extends from the top of the center rotating disc 606. The two are connected by a bearing and can rotate relative to each other. The rotating disc electric motor 609 is arranged on the card collating base 602 and is drivenly connected with the center rotating disc 606 through the transmission belt and/or an intermediate gear 6091. The inner side wall at the bottom of the center rotating disc 606 is integrally formed or fixed with an internal gear ring, and the internal gear ring is meshed with the intermediate gear 6091 for transmission. In other embodiments, the center rotating disc 606 and the rotating disc electric motor 609 may also be connected by other transmission methods, for example, a deceleration mechanism is provided between the two, or a chain is used for transmission.

In this embodiment, the internal structure of the dealer 40 is substantially the same as that of the embodiment 1. The main difference lies in: in this embodiment, the delivery channel is extended to adapt to the setting of the card collating device 6, and the dealer 40 is different in that it is fixed and not rotating. The card receiving position or card receiving box in the card receiving device is rotated for random reception of cards. The specific description is as follows.

As shown in FIG. 28, FIG. 36, FIG. 37, and FIG. 38, the dealer 40 is fixed on the base 1 and is located under the card collating base 602. The dealer includes a storage box 41 and a card dealing device 42, and the upper opening of the storage box 41 is located under the card collating channel outlet 610. One side the bottom of the storage box 41 communicates with the card feeding channel of the card dealing device 42. The card dealing device 42 includes a card distributing mechanism, a delivery mechanism, and a card flipping mechanism. The card flipping mechanism is located below the outer side of the center rotating disc 606. In this embodiment, the storage box 41, the card distributing mechanism, the delivery mechanism, and the card flipping mechanism convey the playing card along the width direction of the playing card. Their structure, principle, operation process, and method can all adopt the structure, principle, operation process, and method in the embodiment 1 as well as the various alternative structures, principles, operation processes, and methods in the embodiment 1. Related description is not incorporated herein.

On the basis of embodiment 1, in this embodiment, the delivery channel of the delivery mechanism is extended. Therefore, it is preferable to provide two identification elements (camera 4238) for identifying the front and back sides of the playing card on the delivery bottom wall 4204 or the delivery top wall 4218 of the delivery channel. Preferably, the two identification elements are arranged diagonally on the playing card to detect the two patterns on the diagonally opposite corners on the front side of the playing card, so as to improve the accuracy and efficiency of identifying the front and back sides of the playing card. The two identification elements can be triggered by the same detection sensor for detecting the presence of the playing card, or can be triggered by the two detection sensors for detecting the presence of the playing card. When the detection sensor detects the playing card, the camera is activated at the same time or delayed, so that the camera can capture right on time the pattern information at the fixed position in the oblique corner of the playing card in the delivery channel. In this way, the controller can identify the front or back side of the playing card according to the pattern information. For example, when the symbol pattern is detected, it is determined that the detected side is the front side. Other structures, principles, operation processes, and methods for identifying the front and back sides of the playing card are the same as embodiment 1 and its various alternative structures, principles, operation processes, and methods.

In this embodiment, it is also preferable to provide a thickness measuring element on the delivery bottom wall 4204 or the delivery top wall 4218 of the delivery channel for detecting whether there are overlapping playing cards when the playing cards pass through the delivery channel. The thickness measuring element includes a rotating member 4240, a thickness measuring wheel 4241, a thickness measuring sensor 4242 and a thickness measuring delivery wheel 4243. The top and bottom of the thickness measuring wheel 4241 correspond to the top and the bottom of the thickness measuring delivery wheel 4243, and they are respectively arranged on the delivery bottom wall 4204 and the delivery top wall 4218 of the delivery channel. The axle of the thickness measuring wheel 4241 is arranged on the rotating member 4240. One end of the rotating member 4240 is hinged with the delivery bottom wall 4204 or the delivery top wall 4218 of the delivery channel, and the other end of the rotating member 4240 is movable and correspondingly operates with the thickness measuring sensor 4242 arranged on the delivery bottom wall 4204 or the delivery top wall 4218, and allows the rotating member 4240 and the thickness measuring wheel 4241 to have the tendency to press the thickness measuring delivery wheel 4243 through the elastic member. When the playing card passes between the thickness measuring wheel 4241 and the thickness measuring delivery wheel 4243, the thickness measuring wheel 4241 and the rotating member 4240 are erected. The thickness measuring sensor 4242 can determine the thickness of the playing card that passes through according to the distance that changes along with the up-down movement of the movable end of the rotating member 4240. When the measured thickness is similar to the thickness of two playing cards or even exceeds the thickness, the controller determines that there are two or more than two playing cards overlapping. The delivery mechanism rejects the playing card to the storage box 41 for the playing card to be fed and distributed again. In this way, it is possible to further avoid error and failures in card distribution. The thickness measurement element can be used in conjunction with the thickness measurement structure or method in embodiment 1, or used alone. Of course, in this embodiment, it is possible to use the thickness measurement structure or method in embodiment 1 alone and its various alternative structures, principles, operation processes, methods.

Figure 30:
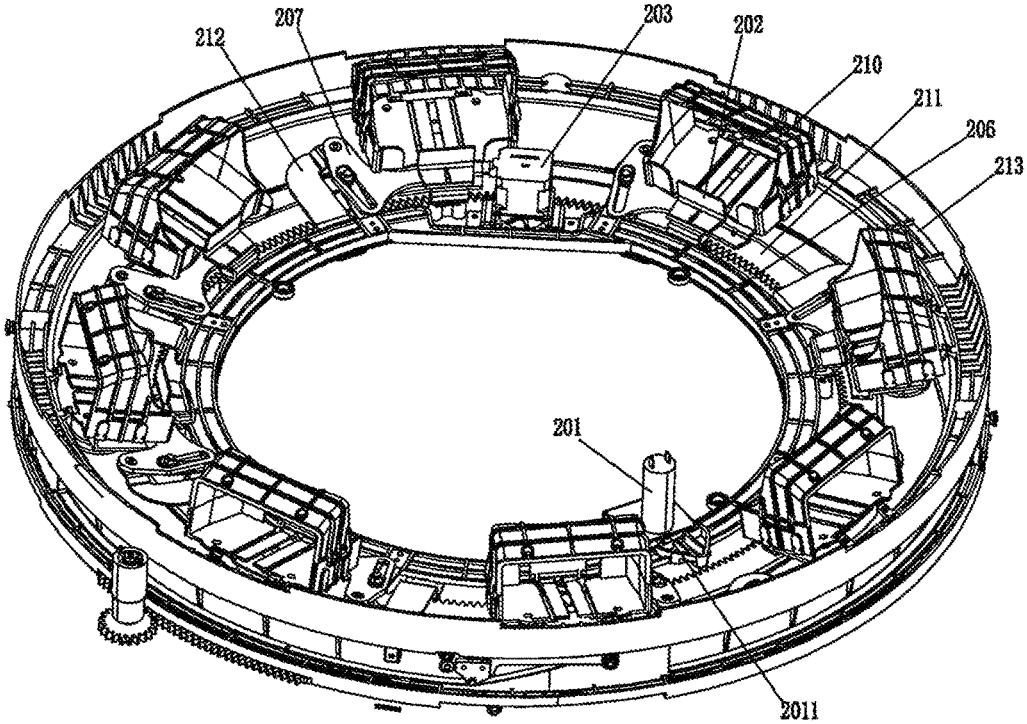
FIG. 30 is a schematic view of the structure of the card receptor in another embodiment of the poker machine of the disclosure (the card rising ring is dropped).
Figure 31:
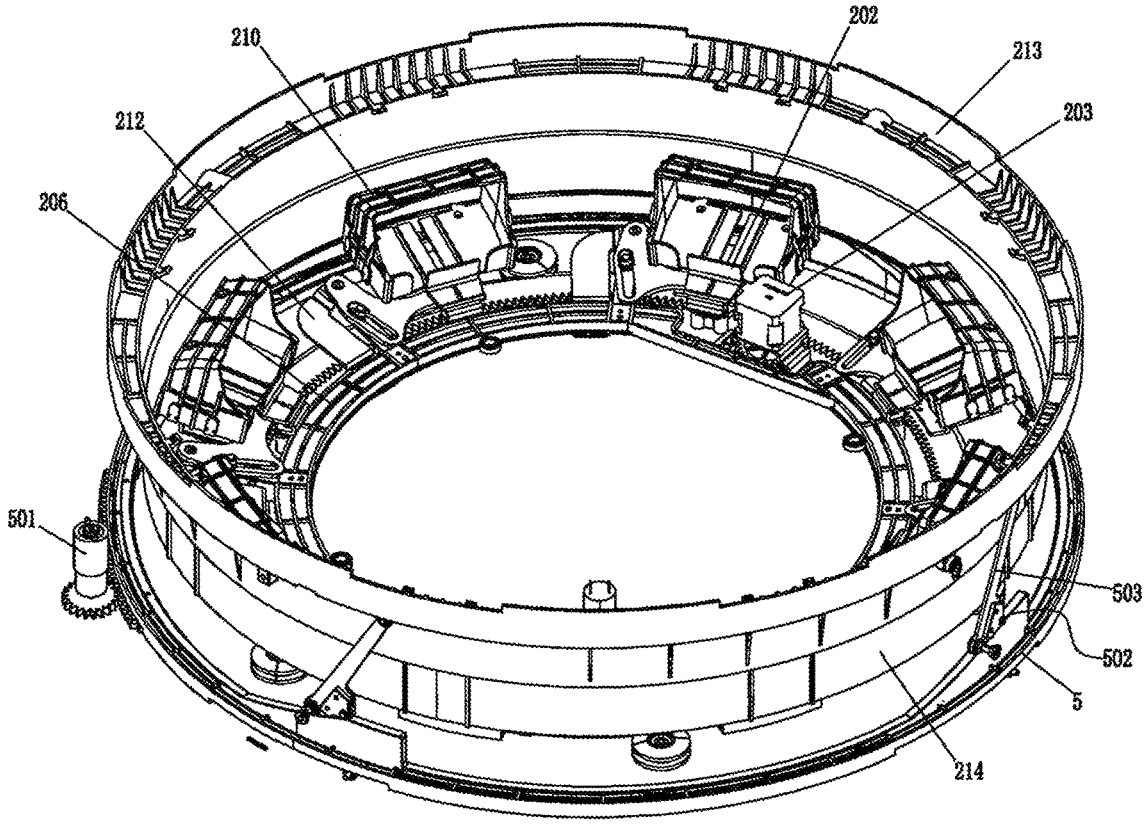
FIG. 31 is a schematic view of the structure of the card receptor in still another embodiment of the poker machine of the disclosure (the card rising ring is raised).

As shown in FIG. 29, FIG. 30, and FIG. 31, in this embodiment, the card receiving device 20 includes a plurality of card receiving boxes 210 and a plurality of card pushing plates 202 arranged around the dealer 40 and the center rotating disc 606, and the card receiving box 210 and the card pushing plates 202 are arranged in one-to-one correspondence. The plurality of card receiving boxes 210 are fixed on a rotating ring 211, the rotating ring 211 is rotatably erected on the base 1 by a plurality of support rollers, and the rotating ring 211 is driven to rotate by the rotating electric motor 203. The bottom of each card receiving box 210 is provided with a card pushing slot for slidingly matching with the card pushing plate 202. The card pushing plate 202 is driven by the card pushing drive mechanism to reciprocate from the inside of the card receiving box 210 to the outside of the card receiving box 210. When the dealer is dealing cards, the card pushing plate 202 moves to the inside of the card receiving box 210 near the dealer. The card receiving box 210 rotates, the card pushing plate 202 does not move, and the playing card is sent to the card receiving box 210. When the card is pushed, the card pushing plate 202 enters the card pushing slot 21 and moves from the inside to the outside to push the playing card on the card receiving box 210 out of the card receiving box 210. The card pushing slot 21 extends from the inner side to the outer side of the card receiving box 210, and the card pushing slot 21 is preferably arranged radially along the circumference of the rotating ring 211. An internal gear is arranged on the inner side of the rotating ring 211, and the rotating electric motor 203 is driven by gear meshing with the internal gear on the rotating ring 211.

The card pushing drive mechanism is arranged on the base 1 and includes a card pushing electric motor 201, a card pushing driver 206, and a plurality of card pushing swing arms 207 corresponding to the plurality of card pushing plates 202 one-to-one. The card pushing driver 206 is round-shaped. The card pushing driver 206 is arranged on the bottom of the base 1 through a plurality of positioning rollers B and is driven to rotate by the card pushing electric motor 201. A plurality of driving parts corresponding to the plurality of pushing swing arms 207 one-to-one are extended from the outer circumference of the card pushing driver 206. One driving part is movably connected with the middle of a card pushing swing arm 207 through a slot A. One end of the card pushing swing arm 207 is movably connected (hinged) with the base 1, and the other end of the card pushing swing arm 207 is movably connected (hinged) with the bottom of the card pushing plate 202. In this way, the respective card pushing swing arms 207 are pushed to rotate by rotating the card pushing driver 206, such that the card pushing plate 202 is pushed to push the playing card from the outside of the card receiving box 210 to the inside of the card receiving box 210 or to reciprocate from the inside of the card receiving box 210 to the outside of the card receiving box 210. Such a card pushing driver synchronously drives a plurality of card pushing plates, with simple structure, reasonable action, reliable operation and low manufacturing cost. The card pushing swing arm 207 is in the shape of a V-shaped return sign. The card pushing electric motor 201 drives the card pushing driver 206 to rotate through a gear and gear ring with a coordination structure, or the card pushing electric motor 201 drives the card pushing driver 206 to rotate through a card pushing cam 2011 and a slot with a coordination structure. The card pushing driver 206 is located inside the rotating ring 211. In order to facilitate the hinged connection with the card pushing swing arm 207, a plurality of card pushing holders 212 corresponding to the card pushing swing arm 207 one-to-one are fixed on the base 1. One end of the card pushing swing arm 207 is hinged with the card pushing holders 212. The hinged position of the card pushing holder 212 is located above the rotating ring 211 and on the inner side of a position where the card receiving box 210 is connected with the rotating ring 211.

In this embodiment, the card receiving box 210 is a through structure. The plurality of card receiving boxes 210 are surrounded by a card blocking ring 214 and a card raising ring 213. The card raising ring 213 is provided with a plurality of card receiving positions corresponding to the card receiving box 210 one-to-one. The card raising ring 213 is driven up and down by the lifting drive mechanism, so that a stack of playing cards of each party is raised from the card serving port 302 to the desktop. In order to save space and optimize the structure, it is preferable to place a stack of playing cards on the card receiving position of the card raising ring 213 in a leaning manner. When cards are dealt, the card blocking ring 214 blocks the cards on the outside of the card receiving box 210 to prevent the playing card from falling out of the card receiving box 210. When the card is pushed, the card blocking ring 214 is lowered and the card pushing plate 202 pushes the playing card in the card receiving box 210 to the card receiving position of the card raising ring 213. Preferably, the card blocking ring 214 is integrally formed or fixedly arranged at the lower part of the card raising ring 213.

The lifting drive mechanism includes a lifting driver 5, a lifting electric motor 501, and a plurality of lifting swing arms 503. The multiple lifting swing arms 503 are evenly distributed under the card raising ring 213. One end of the lifting swing arm 503 is hinged with the base 1, and the other end of the lifting swing arm 503 abuts against the bottom of the card raising ring 213. The lifting electric motor 501 drives the multiple lifting swing arms 503 to swing synchronously through the lifting driver 5 so as to push the card raising ring 213 to lift. In this embodiment, the lifting driver 5 has a circular ring shape, and the top of the circumference of the ring is provided with a plurality of lifting protrusions 502 corresponding to the plurality of lifting swing arms 503. The lifting protrusions 502 abut against the support rollers 5032 in the middle of the lifting swing arm 503. The lifting driver 5 is arranged on the base 1 through support rollers and positioning rollers and can rotate around the center of rotation. In this embodiment, a plurality of support rollers 101 are arranged outside the ring of the lifting driver. The lifting driver is provided with the matching grooves that can limit the rotation range of the lifting driver 5. A number of positioning rollers are arranged inside the ring of the lifting driver 5 so as to position the center of rotation of the lifting driver. When the lifting driver 5 is rotated by being driven by the lifting electric motor 501, the support rollers on the middle of the multiple lifting swing arms 503 respectively move along the corresponding lifting protrusions 502 on the lifting driver 5, so that the lifting protrusions 502 push the lifting swing arms 503 to swing. As such, one end of the lifting swing arm 503 abutting against the bottom of the card raising ring 213 can move up and down, so that the card raising ring 213 can be moved up and down. As shown in FIG. 30 and FIG. 31, in this embodiment, the lifting electric motor 501 drives the lifting driver to rotate through the internal or external meshing of the driving gear and the gear ring. In other embodiments, the lifting electric motor can also be arranged with the driving driver 5 in the same manner as in the embodiment 1.

The poker machine described above includes:

The card collating device 6 is configured to collate the playing cards to face the same side and send them out. The center of the card collating device 6 is provided with a control disk 303. The control disk 303 is driven up and down by the central lifting mechanism. When the control disk 303 is raised, a place for placing the playing card is formed underneath the control disk 303. When the control disk 303 is lowered, the card feeding port is covered. The card collating channel of the card collating device 6 is located under the control disk 303. The card collating device 6 includes the card collating base 602, and the center of the card collating base 602 is provided with the center rotating disc 606 that is driven to rotate by the rotating disc electric motor 609. The card collating base 602 is surrounded by a card collating channel outer side wall 603, and an arc-shaped card collating channel for collating the playing cards is formed between the center rotating disc 606 and the card collating channel outer side wall 603. The bottom of the arc-shaped card collating channel is provided with a plurality of conveying rollers 605 for delivering the playing cards. The rotation direction of the center rotating disc 606 is opposite to the conveying direction along which the conveying rollers 605 deliver the playing cards.

The dealer 40 is used to send the playing cards to the card receiving device 20 one by one. The dealer includes a storage box 41 and a card dealing device 42. The outlet of the card collating device 6 is connected to the storage box 41. The card dealing device 42 includes the card distributing mechanism that separates the playing cards in the storage box into single pieces and sends them to the delivery mechanism, the delivery mechanism that identifies the front and back sides of the playing cards and delivers the playing cards to the card flipping mechanism, as well as the card flipping mechanism that flips the playing card as needed and sends the playing card to the card receiving device.

A card receiving device 20 for receiving playing cards includes a plurality of card receiving boxes 210 arranged around the dealer 40, and the card receiving boxes 210 are driven to rotate relative to the dealer 40 through a rotation drive mechanism.

The playing card collating method of the poker machine as described above includes the following steps:

1) The control disk rises, after putting the playing card into the card collating device, the control disk is lowered.

2) The card collating device arranges the playing cards to face the same direction and sends them to the storage box. The card collating device rotates through the center rotating disc and conveying rollers (when the two rotate, the card moves in the opposite direction), and the cards are arranged to face the same direction so that the cards move along the rotating direction of the conveying rollers.

3) The card distributing mechanism separates the playing cards in the storage box into single pieces and sends them to the delivery mechanism.

4) The delivery mechanism identifies the front and back sides of the playing card and conveys the playing card to the card flipping mechanism.

5) The card flipping mechanism flips the playing card as needed and sends the playing card to respective card receiving boxes in the card receiving device.

6) When the cards are served, the playing card in the card receiving box will be pushed onto the card raising ring by the card pushing plate, and the playing cards of all parties will be raised onto the desktop by the card raising ring.

Specifically, according to the rule set by the player, the control disk electric motor rotates to drive the control disk to rise, and the playing cards can be pushed from different directions of the desktop after the game is finished. The cards that the player pushes into the machine are in different states. Then, the playing cards that have been dealt inside the machine are raised to the desktop according to the setting set by the player. The players proceed to the next game. The playing cards that are pushed by the player into the machine are collated by the card collating device, so that the playing cards are organized in an order with a fixed angle and sent to the card dealing device. The card dealing device detects the card signal, and starts to deal cards one by one according to the rules set by the player. The playing cards that pass through the card dealing device are all flipped to face the same side. According to the set rules, the electric motor rotates randomly to a certain angle, driving the rotation and the card receiving box fixed to the rotating ring to rotate. The cards are randomly sent to the set card receiving box until the set number of playing cards are all dealt. The machine waits for the player to start the next round. At the beginning of the next round, the card pushing electric motor rotates, and the card pushing cam drives the ring-shaped card pushing driver to rotate, so that the pushing card swing arm swings while pushing the card pushing plate, so as to push the cards in the card receiving box to the card raising ring, and the card pushing plate returns to the original position. Under the circumstances, the lifting electric motor works, driving the lifting driver to rotate, thereby pushing the lifting swing arm to rotate, so that the lifting ring rises to the set height, and the card is raised to the desktop to complete the card lifting action. While the machine waits for the player to get the card, the machine starts to collate the cards, flip the cards and deal the cards for the next round.

In the description of this specification, descriptions with reference to the terms "one embodiment", "some embodiments", "examples", "specific examples", or "some examples" etc. mean that specific features, structures, materials or characteristics described in conjunction with the embodiment or example are included in at least one embodiment or example of the present disclosure. In this specification, the schematic expression of the above-mentioned terms do not necessarily refer to the same embodiment or example. Moreover, the described specific features, structures, materials or characteristics can be combined in any one or more embodiments or examples in a suitable manner.

Although the embodiments of the present disclosure have been shown and described above, it should be understood that the above embodiments are exemplary and should not be construed as limiting the present disclosure. Those of ordinary skill in the art can make changes, modification, replacement and variation to the above embodiments without deviating from the principle and purpose of the present disclosure. Any simple changes, modifications, substitutions and modifications made to the above embodiments based on the technical essence of the present disclosure still falls within the scope of technical solution of the disclosure.

What is claimed is:

1. A card collating device of a poker machine, comprising:

a card collating base, a card collating channel outer side wall, and a center rotating disc, wherein the card collating base is directly or indirectly fixed on a base, the center rotating disc is arranged in a center of the card collating base, the center rotating disc is driven by a rotating disc electric motor to rotate, the card collating channel outer side wall is arranged outside the card collating base, an arc-shaped card collating channel for collating playing cards is formed between the center rotating disc and the card collating channel outer side wall, a bottom of the arc-shaped card collating channel is provided with a plurality of conveying rollers for conveying the playing cards, one end of the arc-shaped card collating channel is provided with a card discharging baffle, a card collating channel outlet is formed between the card discharging baffle and the bottom of the arc-shaped card collating channel so as to allow the playing cards to be dealt out in a lengthwise direction of the playing cards, and a storage box of a dealer is located below the card collating channel outlet for receiving the dealt playing cards, wherein a width of the arc-shaped card collating channel is smaller than a length of the playing card and greater than a width of the playing card, a distance between the two adjacent conveying rollers is less than the length of the playing card, and a width of the card collating channel outlet is similar to the width of the playing card.

2. The card collating device of the poker machine according to claim 1, wherein both ends of the arc-shaped card collating channel are provided with the card collating channel outlet, and the two card collating channel outlets are located above opposite sides of the storage box.

3. The card collating device of the poker machine according to claim 1, wherein a top of the center rotating disc is a rotating disc upper tapered surface, and a lower edge of the rotating disc upper tapered surface is provided with several rotating disc card pushing slopes that are arranged along the circumference of the center rotating disc and protrude upward, a lower part of the center rotating disc is provided with a rotating disc side wall at a position close to the bottom of the card collating channel.

4. The card collating device of the poker machine according to claim 1, wherein the plurality of conveying rollers is distributed along a radial direction of the circular center rotating disc, and the conveying rollers adopt tapered rollers with a small inner radius and a large outer radius.

5. The card collating device of the poker machine according to claim 1, wherein the card collating channel outer side wall is mounted rotatably on the card collating base and is driven to rotate by an outer electric motor.

6. The card collating device of the poker machine according to claim 5, wherein the card collating channel outer side wall is formed integrally or fixed with an outer gear and a bottom gear, the outer electric motor fixed on the card collating base or the base is driven by an output gear and the outer gear that mesh with each other to drive the card collating channel outer side wall to rotate, the bottom gear meshes with an outer gear of the conveying rollers to drive the conveying rollers to rotate.

7. The card collating device of the poker machine according to claim 1, wherein a card discharging mechanism is arranged on the card collating channel outlet, and the card discharging mechanism comprises a card discharging active roller and a pressing roller thereof driven by the card discharging electric motor.

8. The card collating device of the poker machine according to claim 1, wherein an upper casing for covering the center rotating disc and the card collating channel is fixed above the card collating base.

9. The card collating device of the poker machine according to claim 1, wherein a control disk is arranged above the center rotating disc, and the control disk is driven up and down by a central lifting mechanism, when the control disk is raised, a card feeding port for placing the playing cards is formed underneath the control disk, and the control disk is lowered to cover the card feeding port; the central lifting mechanism comprises a lifting guide rod, a lifting base, a central lifting cam, and a central lifting electric motor, the control disk is fixed on an upper end of the lifting guide rod, a lifting base is sleeved on the outside of the lifting guide rod, and the lifting base is fixed on the card collating base, a lower part of the lifting base is sleeved with the central lifting cam, both sides of the lifting base are provided with grooves, a lower end of the lifting guide rod is fixed with a support rod, and both ends of the support rod extend out of the groove on the lifting base and can move up and down along the groove, the two protruding ends of the support rod abut against a cam curved surface on the central lifting cam, the central lifting cam is driven to rotate by the central lifting electric motor, thereby driving the support rod and its lifting guide rod to move up and down, and then drive the control disk on the top of the lifting guide rod to move up and down; the center rotating disc is sleeved outside the lifting base, and an upper end of the lifting base extends from a top of the center rotating disc, the two are connected by a bearing and can rotate relative to each other, a bottom of the center rotating disc is integrally formed or fixed with an inner gear ring, the inner gear ring is drivenly connected to the rotating disc electric motor mounted on the card collating base.

* * * * *